US009310751B2

(12) United States Patent
Shimizu et al.

(10) Patent No.: US 9,310,751 B2
(45) Date of Patent: Apr. 12, 2016

(54) BLADE MEMBER, IMAGE FORMING APPARATUS AND PROCESS CARTRIDGE

(71) Applicants: Eisuke Shimizu, Kanagawa (JP); Kazuhiko Watanabe, Tokyo (JP); Takaaki Tawada, Kanagawa (JP); Hisashi Kikuchi, Kanagawa (JP)

(72) Inventors: Eisuke Shimizu, Kanagawa (JP); Kazuhiko Watanabe, Tokyo (JP); Takaaki Tawada, Kanagawa (JP); Hisashi Kikuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/730,957

(22) Filed: Jun. 4, 2015

(65) Prior Publication Data

US 2015/0370217 A1 Dec. 24, 2015

(30) Foreign Application Priority Data

Jun. 24, 2014 (JP) ..... 2014-129694

(51) Int. Cl.
*G03G 15/02* (2006.01)
*G03G 21/00* (2006.01)

(52) U.S. Cl.
CPC ..... *G03G 21/0017* (2013.01)

(58) Field of Classification Search
CPC ..... G03G 15/0233; G03G 21/0017; G03G 21/0011; G03G 21/1814; G03G 2221/0005
USPC ..... 399/350
See application file for complete search history.

(56) References Cited

U.S. PATENT DOCUMENTS

2006/0099016 A1 5/2006 Watanabe et al.
2006/0285898 A1 12/2006 Watanabe et al.
2007/0212137 A1* 9/2007 Sugimoto ..... G03G 21/0017 399/350
2008/0063448 A1 3/2008 Hozumi et al.
2009/0123205 A1 5/2009 Watanabe et al.
2010/0067945 A1 3/2010 Hozumi et al.
2010/0067949 A1 3/2010 Watanabe et al.
2011/0158677 A1 6/2011 Kikuchi et al.
2011/0206431 A1 8/2011 Tawada et al.
2011/0229186 A1* 9/2011 Okamoto ..... G03G 15/161 399/101
2011/0229187 A1 9/2011 Hozumi et al.
2011/0229188 A1 9/2011 Watanabe et al.
2011/0229234 A1 9/2011 Hozumi et al.
2012/0008973 A1 1/2012 Sakakibara et al.
2012/0034006 A1 2/2012 Asaoka et al.
2012/0087704 A1 4/2012 Asaoka et al.
2012/0099883 A1 4/2012 Kikuchi et al.
2014/0178103 A1* 6/2014 Gohda ..... G03G 15/0233 399/176
2014/0233998 A1* 8/2014 Watanabe ..... G03G 21/0017 399/350
2014/0341629 A1 11/2014 Watanabe et al.

FOREIGN PATENT DOCUMENTS

JP 2013-076970 4/2013

* cited by examiner

*Primary Examiner* — Francis Gray
(74) *Attorney, Agent, or Firm* — Harness, Dickey & Pierce

(57) ABSTRACT

A blade includes an elastic member including a tip ridgeline to contact the surface of a member to contact. The tip ridgeline includes an impregnation layer impregnated with a cured compound comprising an acrylate or methacrylate compound having an alicyclic structure including 6 or more carbon atoms in its molecule, and has an elastic power in the range of 50% to 80%.

13 Claims, 8 Drawing Sheets

PROJECTED IMAGE OF PARTICLE PERIPHERAL LENGTH: C1

AREA: S

CIRCLE WITH AREA OF S PERIPHERAL LENGTH: C2

AREA: S

BLADE MEMBER, IMAGE FORMING APPARATUS AND PROCESS CARTRIDGE

CROSS-REFERENCE TO RELATED APPLICATIONS

This patent application is based on and claims priority pursuant to 35 U.S.C. §119 to Japanese Patent Application No. 2014-129694, filed on Jun. 24, 2014, in the Japan Patent Office, the entire disclosure of which is hereby incorporated by reference herein.

BACKGROUND

1. Technical Field

The present invention relates to a blade member, an image forming apparatus and a process cartridge.

2. Description of the Related Art

In electrophotographic image forming apparatuses, residual toner remaining on the surface of a photoreceptor even after a toner image thereon is transferred onto a recording material or an intermediate transfer medium is removed therefrom using a cleaner.

Strip-shaped cleaning blades made of an elastic material such as polyurethane rubbers are typically used for such a cleaner because of having advantages such that the cleaner has simplified structure and good cleanability. Among such cleaning blades, a cleaning blade in which one end thereof is supported by a supporter, and an edge of the other end is contacted with a surface of a photoreceptor to block and scrape off residual toner on the photoreceptor, thereby removing the residual toner from the surface of the photoreceptor.

SUMMARY

Accordingly, one object of the present invention is to provide a blade preventing the tip ridgeline from turning up, being abnormally abraded and making noises, improving its followability on an image bearer, and maintaining its contact pressure thereto without a surface layer.

Another object of the present invention is to provide an image forming apparatus using the blade.

A further object of the present invention is to provide a process cartridge using the blade.

These objects and other objects of the present invention, either individually or collectively, have been satisfied by the discovery of a blade, comprising an elastic member comprising a tip ridgeline configured to contact the surface of an object, wherein the tip ridgeline comprises an impregnation layer impregnated with a cured compound comprising an acrylate or methacrylate compound having an alicyclic structure including 6 or more carbon atoms in its molecule, and has an elastic power in the range of 50% to 80%.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
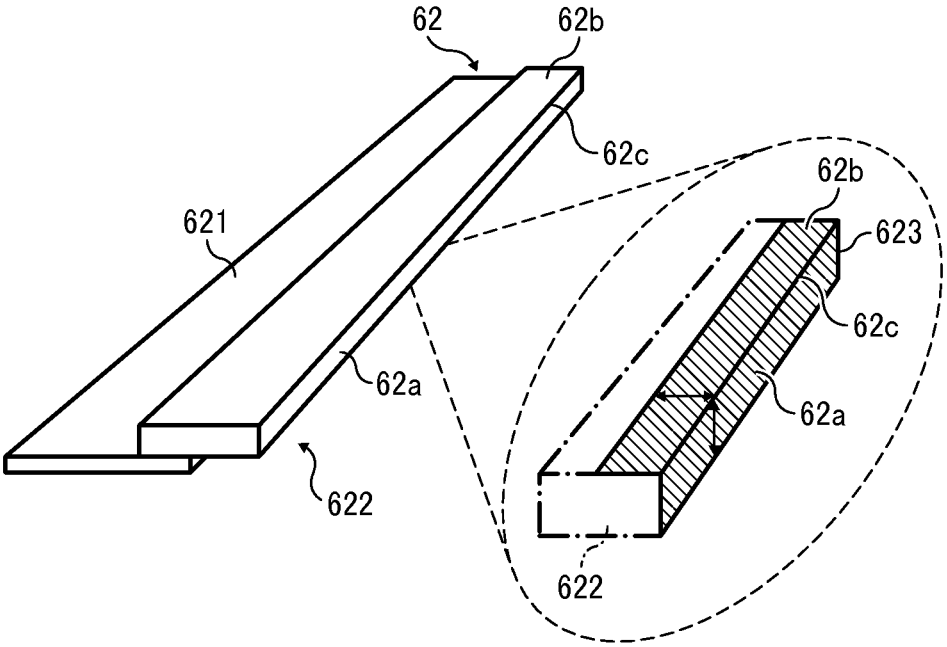
FIG. 1 is a schematic perspective view illustrating an embodiment of the cleaning blade of the present invention.

The present invention provides a blade member preventing the tip ridgeline from turning up, being abnormally abraded and making noises, improving its followability on an image bearer, and maintaining its contact pressure thereto without a surface layer.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

FIG. 1 is a schematic perspective view illustrating an embodiment of the cleaning blade of the present invention.

The cleaning blade 62 includes a strip-shaped elastic member 622 and a holder 621 holding the elastic member 622. A tip ridgeline 62*c* of the elastic member 622 is impregnated with a cured compound to form an impregnation layer 62*d*. The tip ridgeline 62*c* of the elastic member 622 is located contacting the surface of a member in a longitudinal direction thereof to remove unnecessary extraneous matters therefrom.

<Member to Contact>

The member to contact is not particularly limited in materials, shapes, structures and sizes. The member may have the shape of a drum, a belt, a flat plate or a sheet. The size is preferably conventional.

The materials include metals, plastics and ceramics.

The member includes an image bearer when the cleaning blade is used in an image forming apparatus.

<Unnecessary Extraneous Matters>

The unnecessary extraneous matters include toners, lubricants, inorganic particulate materials, organic particulate materials, rubbished, dusts or their mixtures.

<Holder>

The holder is not particularly limited in materials, shapes, structures and sizes. The member may have the shape of a flat plate, a strip or a sheet. The size is preferably selected according to the size of the member to contact.

The materials include metals, plastics and ceramics. Particularly, metallic plates such as stainless steel plates, aluminum plates and phosphor-bronze plates are preferably used in terms of strength.

<Elastic Member>

The elastic member 622 is not particularly limited in materials, shapes, structures and sizes. The member may have the shape of a flat plate, a strip or a sheet. The size is preferably selected according to the size of the member to contact.

Polyurethane rubbers and elastomers are preferably used because of having high elasticity.

The elastic member 622 is prepared by, e.g., mixing a polyol compound and a polyisocyanate compound to prepare a polyurethane prepolymer; crosslinking the polyurethane prepolymer in a specific mold with a curer and curing catalyst when necessary; molding the crosslinked by a centrifugal molder in a furnace to have the shape of a sheet: and then cutting the sheet after aged at normal temperature to have the shape of a flat plate.

The polyol compound includes high-molecular-weight polyols and low-molecular-weight polyols.

Specific examples of the high-molecular-weight polyols include polyester polyol which is a condensation product of alkylene glycol and aliphatic dibasic acid; polyester polyol of alkylene glycol and adipic acid such as ethylene adipate ester polyol, butylene adipate ester polyol, hexylene adipate ester polyol, ethylene propylene adipate ester polyol, ethylene butylene adipate ester polyol and ethylene neopentyl adipate ester polyol; polycaprolactone polyol such as polycaprolactone ester polyol obtained from ring-opening polymerization of caprolactone; and polyether polyol such as poly(oxytetramethylene)glycol and poly(oxypropylene) glycol. These can be used alone or in combination.

Specific examples of the low-molecular-weight polyols include diols such as 1,4-butanediol, ethyleneglycol, neopentylglycol, hydroquinone-bis(2-hydroxyethyl)ether, 3,3'-dichloro-4,4'-diaminophenylmethane and 4,4'-diaminodiphenylmethane; and tri- or more polyols such as 1,1,1-trimethylolpropane, glycerin, 1,2,6-hexanetriol, 1,2,4-butantriol, trimethylolethane, 1,1,1-tris(hydroxy ethoxy methyl) propane, diglycerin and pentaerythritol. These can be used alone or in combination.

Specific examples of the polyisocyanate compound include, but are not limited to, methylene diphenyl diisocyanate (MDI), tolylenediisocyanate (TDI), xylylenediisocyanate (XDI), diphenylmethanediisocyanate, triphenylmethanetriisocyanate, naphthylene 1,5-diisocyanate (NDI), tetramethylxylylenediisocyanate (TMXDI), isophoronediisocyanate (IPDI), polyphenylmethanepolyisocyanate, modified hydrogenated xylylenediisocyanate (H-XDI), hydrogenated xylylene diisocyanate (H6XDI), dicyclo hexyl methane diisocyanate (H12MDI), hexamethylenediisocyanate (HDI), dimer acid diisocyanate (DDI), norbornenediisocyanate (NBDI) and trimethylhexamethylenediisocyanate (TMDI). These isocyanate compounds may be used alone or in combination.

Specific examples of the curing catalyst include, but are not limited to, 2-methylimidazole and 1,2-dimethylimidazole. The catalyst is preferably used in an amount in the range of 0.01% to 0.5% by weight, and more preferably from 0.05% to 0.3% by weight.

The elastic member preferably has a JIS-A hardness not less than 60°, and more preferably from 65° to 80°. When less than 60°, the blade linear pressure is insufficient and the contact area with the member to contact tends to enlarge, resulting in occasional defective cleaning.

The elastic member 622 may be 2 or more layered rubbers having JIS-A hardness different from each other, which is preferable for the elastic member to have both abrasion resistance and followability.

The JIS-A hardness is measured by micro rubber durometer MD-1 from KOBUNSHI KEIKI CO., LTD.

The elastic member 622 preferably has an impact reliance coefficient in the range of 40% to 60% at 23° C. according to JIS K6255. When greater than 60%, the elastic member 622 oscillates and varies contact pressure with the member to contact, resulting in possible defective cleaning. When less than 40%, the followability on microscopic waves on the member to contact possibly deteriorates.

The impact reliance coefficient of the elastic member 622 is measured by a resilience tester No. 221 from Toyo Seiki Seisaku-sho, Ltd. at 23° C. according to JIS K6255.

The elastic member 622 preferably has a thickness in the range of 1.0 to 3.0 mm.

The tip ridgeline 62*c* contacting the surface of the member to contact of the elastic member 622 is impregnated with a cured compound of a UV curable composition including an acrylate or methacrylate compound having an alicyclic structure including 6 or more carbon atoms in its molecule.

The cured compound not only covers the surface of the tip ridgeline 62*c* but also permeates the tip ridgeline 62*c*. Other sites of the elastic member 622 besides the tip ridgeline 62*c* may be impregnated with the cured compound of the UV curable composition.

<<UV Curable Composition>>

The UV curable composition includes acrylate or methacrylate compound having an alicyclic structure including 6 or more carbon atoms in its molecule and other components when necessary.

—Acrylate or Methacrylate Compound Having an Alicyclic Structure Including 6 or More Carbon Atoms in its Molecule—

The acrylate or methacrylate compound having an alicyclic structure including 6 or more carbon atoms in its molecule has bulky specific alicyclic structures, few functional groups and a small molecular weight. Therefore, the acrylate or methacrylate compound easily impregnates the tip ridgeline 62*c* of the elastic member 622.

The alicyclic structures of the acrylate or methacrylate compound having an alicyclic structure including 6 or more carbon atoms in its molecule preferably has 6 to 12, and more preferably 8 to 10 carbon atoms. When less than 6, the tip ridgeline 62*c* occasionally has low hardness. When greater than 12, steric hindrance possibly occurs.

The acrylate or methacrylate compound having an alicyclic structure including 6 or more carbon atoms in its molecule preferably has 2 to 6, and more preferably 2 to 4 functional groups. When less than 2, the tip ridgeline 62*c* occasionally has low hardness. When greater than 6, steric hindrance possibly occurs.

The acrylate or methacrylate compound having an alicyclic structure including 6 or more carbon atoms in its molecule preferably has a molecular weight not greater than 500. When greater than 500, the elastic blade 622 is difficult to impregnate and occasionally difficult to harden.

The acrylate or methacrylate compound having an alicyclic structure including 6 or more carbon atoms in its molecule is preferably at least one of an acrylate or methacrylate compound having a tricyclodecane structure and an acrylate or methacrylate compound having an adamantane structure because of being capable of compensating shortage of crosslinking points with a specific cyclic structure even though having few functional groups.

Specific examples of the acrylate or methacrylate compound having a tricyclodecane structure include, but are not limited to, tricyclodecane dimethanol diacrylate and tricyclodecane dimethanol dimethacrylate. Synthesized or marketed acrylate or methacrylate compounds having a tricyclodecane structure may be used. The marketed products include A-DCP from Shin-Nakamura Chemical Co., Ltd., etc.

Specific examples of the acrylate or methacrylate compound having an adamantane structure include, but are not limited to, 1,3-adamantane dimethanol diacrylate, 1,3-adamantane dimethanol dimethacrylate, 1,3,5-adamantane trimethanol triacrylate and 1,3,5-adamantane trimethanol trimethacrylate.

Synthesized or marketed acrylate or methacrylate compounds having an adamantane structure may be used. The marketed products include X-DA and X-A-201 from Idemitsu Kosan Co., Ltd.; and ADTM from Mitsubishi Gas Chemical Company, Inc.

The content of the acrylate or methacrylate compound having an alicyclic structure including 6 or more carbon atoms in its molecule is preferably from 20% to 100% by weight, and more preferably from 50% to 100% by weight based on total weight of the UV curable composition. When less than 20% by weight, hardness owing to the specific cyclic structure is occasionally impaired.

Whether the acrylate or methacrylate compound having an alicyclic structure including 6 or more carbon atoms, preferably the acrylate or methacrylate compound having a tricyclodecane structure or an adamantane structure, is included in the tip ridgeline 62*c* of the elastic member 622 can be detected by an IR microscope or a liquid chromatography.

The UV curable composition may include an acrylate or methacrylate compound having a molecular weight in the range of 100 to 1,500 besides the acrylate or methacrylate compound having an alicyclic structure including 6 or more carbon atoms.

Specific examples of the acrylate or methacrylate compound having a molecular weight in the range of 100 to 1,500 include, but are not limited to, dipentaerythritol hexa(meta) acrylate, pentaerythritol tetra(meta)acrylate, pentaerythritol tri(meta)acrylate, pentaerythritol ethoxy tetra(meta)acrylate, trimethylol propane tri(meta)acrylate, trimethylol propane ethoxy tri(meta)acrylate, 1,6-hexanediol di(meta)acrylate, ethoxylated bisphenol A di(meta)acrylate, propoxylated bisphenol A di(meta)acrylate, 1,4-butanediol di(meta)acrylate, 1,5-pentanediol di(meta)acrylate, 1,6-hexanediol di(meta)acrylate, 1,7-heptanediol di(meta)acrylate, 1,8-octanediol di(meta)acrylate, 1,9-nonanediol di(meta)acrylate, 1,10-decanediol di(meta)acrylate, 1,11-undecanediol di(meta)acrylate, 1,18-octadecanediol di(meta)acrylate, glycerin propoxy tri(meta)acrylate, the propylene glycol di(meta)acrylate, tripropylene glycol di(meta)acrylate, PO-modified neopentylglycol di(meta)acrylate, PEG600 di(meta)acrylate, PEG400 di(meta)acrylate, PEG200 di(meta)acrylate, neopentyl glycol hydroxy pivalic acid ester di(meta)acrylate, octyl/decyl (meta)acrylate, isobornyl (meta)acrylate, ethoxylated phenyl (meta)acrylate, and 9,9-bis[4-(2-(meta)acryloyl oxy ethoxy)phenyl]fluorene. These can be used alone or in combination. Particularly, a compound having a pentaerythritoltriacrylate structure having 3 to 6 functional groups is preferably used.

Specific examples of the compound having a pentaerythritoltriacrylate structure having 3 to 6 functional groups include pentaerythritoltriacrylate, dipentaerythritol hexane acrylate, etc.

Specific examples of the other components included in the UV curable composition besides the acrylate or methacrylate compound having an alicyclic structure including 6 or more carbon atoms include, but are not limited to, a photopolymerization initiator, a polymerization inhibitor and a diluent.

—Photopolymerization Initiator—

Specific examples of the photopolymerization initiator include, but are not limited to, photo-radical polymerization initiators and photo-cation polymerization initiators. Particularly, the photo-radical polymerization initiators are preferably used.

Specific examples of the photo-radical polymerization initiators include aromatic ketones, acyl phosphine oxide compounds, aromatic onium salt compounds, organic peroxides, thio compounds such as thioxanthone compounds and compounds including a thiophenyl group, hexaaryl diimidazole compounds, keto oxime ester compounds, borate compound, azinium compounds, metallocene compounds, active ester compounds, compounds having a carbon halogen bond, alkylamine compounds, etc.

Specific examples of the photo-radical polymerization initiators include, but are not limited to, acetophenone, acetophenone benzyl ketal, 1-hydroxy cyclohexyl phenyl ketone, 2,2-dimethoxy-2-phenyl acetophenone, xanthone, fluorenone, benzaldehyde, fluorene, anthraquinone, triphenyl amine, carbazole, 3-methyl acetophenone, 4-chlorobenzophenone, 4,4'-dimethoxy benzophenone, 4,4'-diaminobenzophenone, Michler's ketone, benzoin propyl ether, benzoin ethyl ether, benzyl dimethyl ketal, 1-(4-isopropylphenyl)-2-hydroxy-2-methyl propan-1-one, 2-hydroxy-2-methyl-1-phenyl propan-1-one, thioxanthone, diethylthio xanthone, 2-isopropylthio xanthone, 2-chlorothioxanthone, 2-methyl-1-[4-(methylthio)phenyl]-2-morpholino-propane-1-one, bis(2,4,6-trimethyl benzoyl)-phenyl phosphine oxide, 2,4,6-trimethyl benzoyl-diphenyl-phosphine oxide, 2,4-diethyl thioxanthone, and bis-(2,6-dimethoxy benzoyl)-2,4,4-trimethyl pentyl phosphine oxide. These can be used alone or in combination.

Marketed photo-radical polymerization initiators such as Irgacure 651, Irgacure 184, DAROCUR 1173, Irgacure 2959, Irgacure 127, Irgacure 907, Irgacure 369, Irgacure 379, DAROCUR TPO, Irgacure 819, Irgacure 784, Irgacure OXE 01, Irgacure OXE 02 and Irgacure 754 from Ciba Speciality Chemicals Inc.; Speedcure TPO from Lambson Limited; KAYACURE DETX-S from Nippon Kayaku Co., Ltd.; Lucirin TPO, LR8893, LR8970 from BASF AG; and EBECRYL P36 from UCB can be used. These can be used alone or in combination.

The content of the photo-radical polymerization initiator is preferably from 1 to 20% by weight based on total weight of the UV curable composition.

—Polymerization Inhibitor—

Specific examples of the polymerization inhibitor include, but are not limited to, phenolic compounds such as p-methoxyphenol, cresol, t-butyl catechol, the-t-butyl para-cresol, hydroquinone monomethyl ether, α-naphthol, 3,5-di-t-butyl-4-hydroxytoluene, 2,2'-methylene bis(4-methyl-6-t-butylphenol), 2,2'-methylene bis(4-ethyl-6-butylphenol), and 4,4'-thiobis(3-methyl-6-t-butyl phenol); quinone compounds such as p-benzoquinone, anthraquinone, naphthoquinone, phenanthraquinone, p-xyloquinone, p-toluquinone, 2,6-dichloroquinone, 2,5-diphenyl-p-benzoquinone, 2,5-diacetoxy-p-benzoquinone, 2,5-dicaproxy-p-benzoquinone, 2,5-diacyloxy-p-benzoquinone, hydroquinone, 2,5-di-butyl hydroquinone, mono-t-butyl hydroquinone, monomethyl hydroquinone, and 2,5-di-t-amyl hydroquinone; amine compounds such as phenyl-β-naphthylamine, p-benzyl aminophenol, the-β-naphthyl paraphenylene diamine, dibenzyl hydroxylamine, phenyl hydroxyl amine, and diethyl hydroxyl amine; nitro-compounds such as dinitrobenzene, trinitrotoluene and picric acid; oxime compounds such as quinone dioxime and cyclohexanone oxime; and sulfur compounds such as phenothiazine. These can be used alone or in combination.

Specific examples of the diluent include, but are not limited to, hydrocarbon-based solvents such as toluene and xylene; ester-based solvents such as ethyl acetate, acetic acid n-butyl, methylcellosolve acetate and propylene glycol monomethyl ether acetate; ketone-based solvents such as methyl ethyl ketone, methyl isobutyl ketone, diisobutyl ketone, cyclohexanone and cyclopentanone; ether-based solvents such as ethylene glycol monomethyl ether, ethylene glycol monoethyl ether and propylene glycol monomethyl ether; and alcohol-based solvents such as ethanol, propanol, 1-butanol, isopropyl alcohol and isobutyl alcohol. These can be used alone or in combination.

Methods of impregnating the tip ridgeline 62*c* of the elastic member 622 with the cured material of the UV curable composition including the acrylate or methacrylate compound having an alicyclic structure including 6 or more carbon atoms in its molecule to cure the tip ridgeline 62*c* include, but are not limited to, brushing or dipping the tip ridgeline 62*c* with the UV curable composition to be impregnated therewith, and irradiating the tip ridgeline 62*c* with UV light, preferably in an accumulated light amount in the range of 500 to 5,000 mJ/cm$^2$ to be cured.

The tip ridgeline 62*c* is impregnated with the cured material of the UV curable composition including the acrylate or methacrylate compound having an alicyclic structure including 6 or more carbon atoms in its molecule, preferably the acrylate or methacrylate compound having a tricyclodecane structure or an adamantane structure, to be highly hardened, which prevents the tip ridgeline 62*c* from turning up in a travel direction of the member to contact or deforming due to a frictional force therewith.

The impregnated tip ridgeline 62*c* preferably has an elastic power in the range of 50% to 80%.

Figure 2:
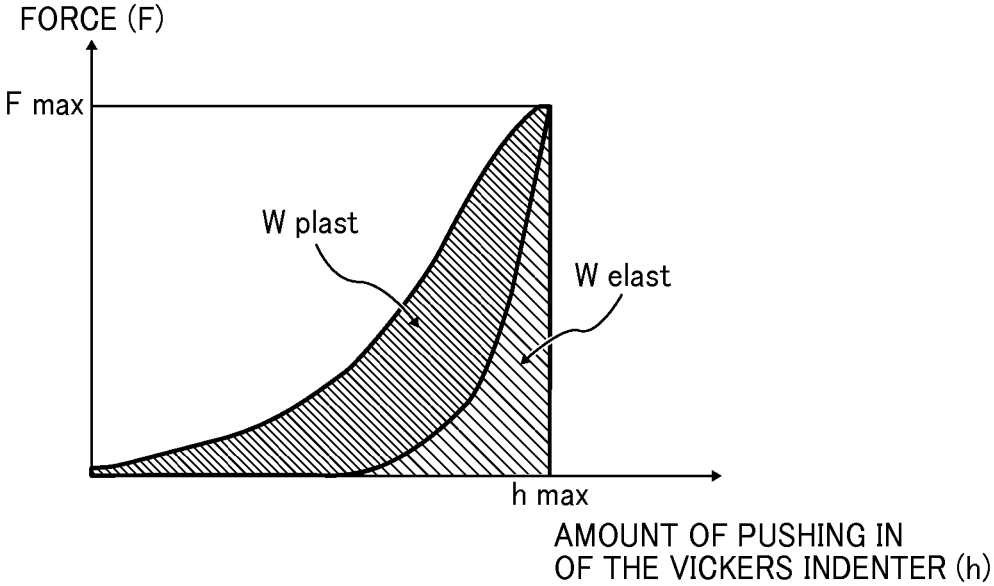
FIG. 2 is a diagram for explaining an elastic power.

The elastic power is measured as follows from multiplied stress when measuring Martens hardness. When the multiplied stress when Vickers indenter is pushed into is Wplast and the multiplied stress when a test load is unloaded is Welast, the elastic power is Welast/Wplast×100% (FIG. 2). The higher the elastic power, the less the hysteresis loss (plastic deformation), i.e., closer to rubber. When the elastic power is too low, closer to glass.

When the elastic power is less than 50%, the abrasion speed noticeably increases under low temperature environment and defective cleaning possibly occurs earlier under low temperature environment. When greater than 80%, the tip ridgeline 62*c* possibly turns up in a travel direction of the member to contact or deforms due to a frictional force therewith.

The cleaning blade 62 of the embodiment prevents the tip ridgeline 62*c* from turning up, decreases abrasion thereof, and maintains good cleanability for long periods. This is why the blade is widely used in various fields, and preferably used in the following image forming apparatus, image forming method and process cartridge.

(Image Forming Apparatus and Image Forming Method)

The image forming apparatus includes at least a charger, an irradiator, an image developer and a transferer, a fixer, a cleaner and other means when necessary. A combination of the charger and the irradiator is expedientially called as an electrostatic latent image former.

The image forming method includes at least a charging process, an irradiation process, a development process, a transfer process, a fixing process, a cleaning process and other processes when necessary. A combination of the charging process and the irradiating process is expedientially called as an electrostatic latent image forming process.

The image forming method is preferably performed by the image forming apparatus, the charging process by the charger, the irradiation process by the irradiator, the development process by the image developer, the transfer process by the transferer, the fixing process by the fixer, the cleaning process by the cleaner and the other processes by the other means.

<Image Bearer>

The image bearer (called "electrophotographic photoreceptor" or "photoreceptor" occasionally) is not particularly limited in materials, shape, structure and size, but preferably has the shape of a drum or a belt. The materials includes inorganic materials such as amorphous silicon and selenium, and organic materials such as polysilane and phthalopolymethine.

<Charging Process and Charger>

The charging process is a process of charging the surface of the electrophotographic photoreceptor, which is performed by the charger.

Specific examples of the charger include, but are not limited to, known contact chargers including an electroconductive or semi-conductive roll, brush, film or rubber blade; and non-contact chargers located close to the electrophotographic photoreceptor using corona discharge such as corotron and scorotron.

The charger may include any type of charging member such as roller, magnetic brush, and fur brush. The magnetic brush may be comprised of ferrite particles (e.g., Zn—Cu ferrite), a non-magnetic conductive sleeve for supporting the ferrite particles, and a magnet roll internally contained in the sleeve. The fur brush may be comprised of a metallic or conductive cored bar and a fur which is treated with a conductive material such as carbon, copper sulfide, metal, or metal oxide, winding around or attaching to the cored bar.

In some embodiments, contact chargers are used for the purpose of reducing generation of ozone.

In some embodiments, the charger is disposed in contact or non-contact with the electrophotographic photoreceptor, and supplies a direct current voltage overlapped with an alternating current voltage to the electrophotographic photoreceptor.

In some embodiments, the charger is a non-contact charging roller disposed proximal to the electrophotographic photoreceptor having a gap tape, and charges the surface of the electrophotographic photoreceptor by being supplied with a direct current voltage overlapped with an alternating current voltage.

<Irradiation Process and Irradiator>

The irradiation process is a process of irradiating the charged surface of the electrophotographic photoreceptor, which is performed by the irradiator.

Optical systems in the irradiation are broadly classified into an analog optical system and a digital optical system. The analog optical system directly projects an original image onto the image bearer. The digital optical system receives an electrical signal including image information, converts the signal into an optical signal, and irradiates an electrophotographic photoreceptor therewith to form an electrostatic latent image thereon.

The irradiator is not particularly limited, and can be selected from any irradiators if it can irradiate the charged surface of the electrophotographic photoreceptor imagewise. Specific examples thereof include various irradiators such as reprographic optical irradiators, rod lens array irradiators, laser optical irradiators, liquid crystal shutter optical irradiators and LED optical irradiators.

In the present invention, it is possible to irradiate the electrophotographic photoreceptor from the backside thereof.

<Development Process and Image Developer>

The development process is a process of developing the electrostatic latent image with a toner to form a visible image, which is performed by the image developer.

The image developer is not particularly limited, and can be selected from any image developers if it can develop with the toner or a developer. The image developer includes a developing unit adapted to store and supply the toner or the developer to the electrostatic latent image with or without contacting the electrostatic latent image.

The image developer may employ either a dry developing method or a wet developing method. The image developer may be either a single-color image developer or a multi-color image developer. The image developer may be comprised of an agitator for frictionally agitating and charging the developer and a rotatable magnet roller.

Toner particles and carrier particles are mixed and agitated within the image developer so that the toner particles are frictionally charged. The charged toner particles and carrier particles are borne on the surface of the magnet roller forming chainlike aggregations (hereinafter "magnetic brush"). The magnet roller is disposed adjacent to the electrophotographic photoreceptor. Therefore, a part of the toner particles in the magnetic brush migrates from the surface of the magnet roller to the surface of the electrophotographic photoreceptor due to electrical attractive force. As a result, the electrostatic latent image formed on the electrophotographic photoreceptor is developed with the toner to form a visual image.

The toner contained in the image developer may be a developer including the toner, and the developer may be a one-component or a two-component developer.

—Toner—

The toner includes a base particle, an external additive and other components when necessary.

The toner may be a monochrome toner or a color toner.

The base particle includes at least a binder resin and a colorant, and optional other components such as a release agent and a charge controlling agent.

—Binder Resin—

Specific examples of the binder resins for use in the present invention include, but are not limited to, in addition to the polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-.alpha.-methyl chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, polyacrylate resins, rosin, modified rosins, terpene resins, aliphatic or alicyclic hydrocarbon resins, aromatic petroleum resins, chlorinated paraffin, paraffin waxes, etc. These resins can be used alone or in combination. Among these, compared with the styrene resins an acrylic resins, the polyester resin is preferably used because of being capable of lowering melt viscosity while keeping storage stability of the toner.

The polyester resin can be obtained by a polycondensation reaction between an alcoholic component and a carboxylic component.

Specific examples of the alcoholic component include, but are not limited to diols such as polyethylene glycol, diethylene glycol, triethylene glycol, 1,2-propylene glycol, 1,3-propylene glycol, 1,4-propylene glycol, neopentyl glycol and 1,4-butenediol; etherified bisphenol A such as 1,4-bis(hydroxymethyl)cyclohexane, bisphenol A, hydrogenated bisphenol A, polyoxyethylenated bisphenol A, polyoxypropylenated bisphenol A; their dihydric alcoholic monomers substituted with a saturated or unsaturated hydrocarbon group having 3 to 22 carbon atoms; other dihydric alcoholic monomers; and multivalent alcoholic monomers having 3 or more valences such as sorbitol, 1,2,3,6-hexanetetrol, 1,4-sorbitan, pentaerythritol, dipentaerythritol, tripentaerythritol, saccharose, 1,2,4-butanetriol, 1,2,5-pentanetriol, glycerol, 2-methylpropanetriol, 2-methyl-1,2,4-butanetriol, trimethylol ethane, trimethylol propane and 1,3,5-trihydroxymethylbenzene.

Specific examples of suitable carboxylic acids include, but are not limited to, monocarboxylic acids (e.g., palmitic acid, stearic acid, oleic acid), maleic acid, fumaric acid, mesaconic acid, citraconic acid, terephthalic acid, cyclohexane dicarboxylic acid, succinic acid, adipic acid, sebacic acid, malonic acid, divalent organic acids in which the above compounds are substituted with a saturated or unsaturated hydrocarbon group having 3 to 22 carbon atoms, anhydrides and lower esters of the above compounds, dimer acids of linoleic acid, and tri- or more valent carboxylic acids (e.g., 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl) methane, 1,2,7,8-octanetetracarboxylic acid enpol trimmer acid, and anhydrides of these compounds).

—Colorant—

Specific examples of the colorants for use in the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The toner preferably includes the colorant in an amount in the range of 1 to 15% by weight, and more preferably from 3% to 10% by weight.

The colorant for use in the present invention can be used as a master batch pigment when combined with a resin. Specific examples of the resin for use in the master batch pigment or for use in combination with master batch pigment include styrene polymers and substituted styrene polymers; styrene copolymers; and other resins such as polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

—Release Agent—

Specific examples of the release agent include known waxes, e.g., waxes including a carbonyl group; polyolefin waxes such as polyethylene wax and polypropylene wax; and long chain hydrocarbons such as a paraffin wax and a sasol wax. These can be used alone or in combination. Among these, the waxes including a carbonyl group are preferably used Specific examples of the waxes including a carbonyl group include ester polyalkanates such as a carnauba wax, a montan wax, trimethylolpropanetribehenate, pentaerythritoltetrabehenate, pentaerythritoldiacetatedibehenate, glycerinetribehenate, and 1,18-octadecanedioldistearate; polyalkanolesters such as tristearyltrimelliticate and distearylmaleate; amide polyalkanates such as ethylenediaminedibehenylamide; polyalkylamides such as tristearylamidetrimelliticate; and dialkylketones such as distearylketone. Among these, ester polyalkanates are preferably used.

The toner preferably includes the release agent in an amount in the range of 5% to 15% by weight.

—Charge Controlling Agent—

The toner of the present invention may optionally include a charge controlling agent. Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc.

The content of the charge controlling agent is, but is not limited to, preferably from 0.1 to 10 parts by weight, and more preferably from 0.2 to 5 parts by weight, per 100 parts by weight of the binder resin included in the toner.

—External Additive—

Specific examples of the external additive include, but are not limited to, inorganic particulate material such as silica, titanium oxide, alumina, carbonated silicon, silicon nitride and boron nitride; and particulate resins such as particulate polymethylmethacrylate having an average particle diameter in the range of 0.05 to 1 μm obtained by soap-free emulsion polymerization methods, and particulate polystyrene. These can be used alone or in combination. Among these, hydrophobized silica is preferably used.

Such a silica includes silicone-treated silica. The surface of the silica is treated (hydrophobized) with silicone oil.

The surface treatment method is not particularly limited. Specific examples of the silicone oil include dimethyl silicone oil, methylhydrogen silicone oil, methyl phenyl silicone oil, etc. Marketed products of the silicone-treated silica can be used, such as RY200, R2T200S, NY500 and RY50 from Nippon Aerosil Co., Ltd.

—Other Components—

The other components included in the toner include, but are not limited to, a fluidity improver, a cleanability improver, a magnetic material, a metal soap, etc.

The fluidity improver improves the hydrophobicity of particles due to surface-treatment, thereby preventing the particles from deteriorating in fluidity and chargeability even in humid circumstances. Specific examples of the fluidity improver include, but are not limited to, a silane coupling agent, silylating agent, silane coupling agent having a fluorinated alkyl group, organic titanate type coupling agent, aluminum type coupling agent, silicone oil, and modified silicone oil.

The cleaning improver that improves the cleanability of the toner is added to the toner to remove an un-transferred development agent remaining on a photoreceptor and a primary transfer medium. Specific examples of the cleaning improver include, but are not limited to, zinc stearate, calcium stearate, metal salts of fatty acids such as stearic acid, and polymer particulates produced by soap-free emulsion polymerization such as polymethylmethacrylate particulates and polystyrene particulates. Preferably, the polymer particulates have a relatively narrow particle size distribution and a volume average particle diameter in the range of 0.01 to 1 μm.

Specific examples of the magnetic material include, but are not limited to, iron powder, magnetite and ferrite. They are preferably white in terms of color tone.

—Method of Preparing Toner—

Methods of preparing the toner are not particularly limited, and known methods such as kneading & pulverization methods; polymerization methods; solution suspension methods; and spray granulation methods can be used. The polymerization methods such as suspension polymerization methods, emulsion polymerization methods and dispersion polymerization methods forming a toner having high circularity and small particle diameter to improve image quality are preferably used.

—Kneading-Pulverization Method—

The kneading-pulverization method is a method for producing toner base particles, for example, by melting and kneading a toner composition containing at least a colorant and a binder resin, pulverizing the resulting kneaded product, and classifying the pulverized particles.

In the melting and kneading, materials of the toner composition are mixed, and the resulting mixture is placed in a melt-kneader to perform melting and kneading. As the melt-kneader, for example, a monoaxial or biaxial continuous kneader, or a batch-type kneader with a roll mill can be used. Preferable examples thereof include a twin screw extruder KTK manufactured by KOBE STEEL, LTD., an extruder TEM manufactured by TOSHIBA MACHINE CO., LTD., a twin screw extruder manufactured by KCK Co., Ltd., a twin screw extruder PCM manufactured by Ikegai Corp., and a cokneader manufactured by Buss. The melt-kneading is preferably performed under the appropriate conditions so as not to cause scission of molecular chains of the binder resin. Specifically, the temperature of the melt-kneading is adjusted under taking the softening point of the binder resin as consideration. When the temperature of the melt-kneading is very high compared to the softening point, the scission occurs significantly. When the temperature thereof is very low compared to the softening point, the dispersing may not be progressed.

In the pulverizing process, it is preferable that the kneaded mixture is at first crushed to prepare coarse particles and then the coarse particles are pulverized to prepare fine particles. In the pulverizing step, a method of crashing the coarse particles against a collision plate by jet air or a method of passing the coarse particles through a narrow gap between a mechanically rotating rotor and a stator is preferably used.

In the classifying process, the pulverized mixture is classified into particles having a predetermined particle diameter. The classification is made by cyclone, decanter and centrifugal separation, etc. to remove microscopic particles.

After the microscopic particles are removed, pulverized mixture is further air-classified by a centrifugal force to prepare a parent toner having a predetermined particle diameter.

Next, an external additive is added to the toner base particle. They are mixed and stirred such that the external additive is coated on the surface of the toner base particle while crushed. It is important that the external additive such as particulate silica uniformly and firmly adheres thereto.

—Polymerization Method—

The polymerization methods include, e.g., dissolving or dispersing toner materials including at least a modified urea or urethane bondable polyester resin and a colorant in an organic solvent, dispersing the solution or dispersion in an aqueous medium to be subjected to polyaddition, removing the solvent from the dispersion, and washing.

The modified urea or urethane bondable polyester resin includes a polyester prepolymer having an isocyanate group obtained from a reaction between a carboxyl group or a hydroxyl group of the polyester and a polyisocyanate compound (PIC). The polyester prepolymer and amines are reacted such that the molecular chains are crosslinked and/or elongated to obtain a modified polyester resin improving hot offset resistance while keeping low-temperature fixability.

Specific examples of the PIC include aliphatic polyisocyanate such as tetramethylenediisocyanate, hexamethylenediisocyanate and 2,6-diisocyanatemethylcaproate; alicyclic polyisocyanate such as isophoronediisocyanate and cyclohexylmethanediisocyanate; aromatic diisocyanate such as tolylenedisocyanate and diphenylmethanediisocyanate; aroma aliphatic diisocyanate such as $\alpha,\alpha,\alpha',\alpha'$-tetramethylxylylenediisocyanate; isocyanurate; the above-mentioned polyisocyanate blocked with phenol derivatives, oxime and caprolactam; and their combinations.

The PIC is mixed with polyester such that an equivalent ratio ([NCO]/[OH]) between an isocyanate group [NCO] and polyester having a hydroxyl group [OH] is typically from 5/1 to 1/1, preferably from 4/1 to 1.2/1 and more preferably from 2.5/1 to 1.5/1.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophorone diamine); aliphatic diamines (e.g., ethylene diamine, tetramethylene diamine and hexamethylene diamine); etc.

Specific examples of the polyamines (B2) having three or more amino groups include diethylene triamine, triethylene tetramine.

Specific examples of the amino alcohols (B3) include ethanol amine and hydroxyethyl aniline.

Specific examples of the amino mercaptan (B4) include aminoethyl mercaptan and aminopropyl mercaptan.

Specific examples of the amino acids (B5) include amino propionic acid and amino caproic acid.

Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) and mixtures in which a diamine is mixed with a small amount of a polyamine (B2) are preferably used.

The mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2.

The polymerization methods prepare a spherical toner having a small particle diameter with less environmental load at low cost.

Specific examples of dispersers include, but are not limited to, known dispersers such as low-speed shearing dispersers, high-speed shearing dispersers, friction dispersers, high-pressure jet dispersers and ultrasonic dispersers.

The high-speed shearing dispersers are preferably used to prepare dispersed materials (oil droplets) having a particle diameter in the range of 2 to 20 μm.

The high-speed shearing dispersers preferably rotate at from 1,000 to 30,000 rpm, and more preferably from 5,000 to 20,000 rpm.

In addition, the dispersion time is also not particularly limited, but the dispersion time is preferably from 0.1 to 5 minutes for batch methods.

The temperature in the dispersion process is typically 0° C. to 150° C. (under pressure), and preferably from 40° C. to 98° C. The processing temperature is preferably as high as possible because the viscosity of the dispersion decreases and thereby the dispersing operation can be easily performed.

The content of the aqueous medium to 100 parts by weight of the toner material is preferably from 50 to 2,000 parts by weight, and more preferably from 100 to 1,000 parts by weight.

The organic solvent is removed from the dispersion by a method of gradually heating the dispersion to completely evaporate the organic solvent in the oil drop or a method of spraying the emulsified dispersion in a dry atmosphere to completely evaporate the organic solvent in the oil drop and to evaporate the aqueous dispersant, etc. When removed, base toner particles are formed. The base toner particles are washed, dried and further classified if desired. The base toner particles are classified by removing fine particles with a cyclone, a decanter, a centrifugal separator, etc. in the dispersion. Alternatively, the base toner particles may be classified as a powder after dried.

The thus prepared dry base toner particles can be mixed with one or more other particulate materials such as external additives mentioned above, release agents, charge controlling agents, fluidizers and colorants optionally upon application of mechanical impact thereto to fix the particulate materials on the base toner particles.

Specific examples of such mechanical impact application methods include methods in which a mixture is mixed with a highly rotated blade and methods in which a mixture is put into a jet air to collide the particles against each other or a collision plate.

Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

The toner preferably has an average circularity not less than 0.97, and more preferably from 0.97 to 0.98 to produce high-quality images having satisfactory transferability without toner scattering.

The average circularity of the toner is measured using a flow particle image analyzer FPIA-2000 from Sysmex Corp. The procedure is as follows:

(1) initially, 100 to 150 ml of water, from which solid foreign materials have been removed, 0.1 to 0.5 ml of a surfactant (e.g., alkylbenzenesulfonate) and 0.1 to 0.5 g of a sample (i.e., toner) are mixed to prepare a dispersion;

(2) the dispersion is further subjected to a supersonic dispersion treatment for 1 to 3 minutes using a supersonic dispersion machine to prepare a dispersion including particles at a concentration in the range of 3,000 to 10,000 pieces/μl;

(3) the dispersion set in the analyzer so as to be passed through a detection area formed on a plate in the analyzer; and (4) the particles of the sample passing through the detection area are optically detected by a CCD camera and then the shapes of the toner particles and the distribution of the shapes are analyzed with an image analyzer to determine the average circularity of the sample.

Figure 3A:
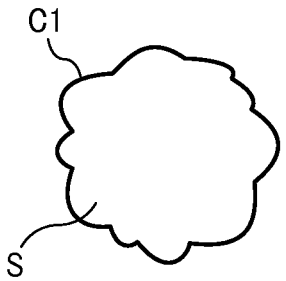
FIGS. 3A and 3B are schematic views for explaining the way to determine the circularity of toner.
Figure 3B:
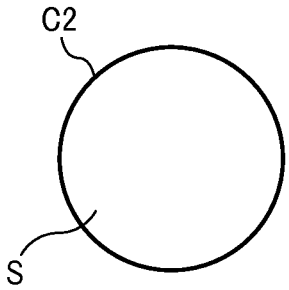

The method for determining the circularity of a particle will be described by reference to FIGS. 4A and 4B. When the projected image of a particle has a peripheral length C1 and an area S as illustrated in FIG. 3A, and the peripheral length of the circle having the same area S is C2 as illustrated in FIG. 3B, the circularity of the particle is obtained by the following equation.

$$\text{Circularity}=C2/C1$$

The average circularity of the toner is obtained by averaging circularities of particles.

The toner preferably has a volume-average particle diameter not greater than 5.5 μm.

The toner preferably has a ratio (Dv/Dn) of the volume-average particle diameter (Dv) to a number-average particle diameter (Dn) in the range of 1.00 to 1.40. The closer to 1.00, the shaper the particle diameter distribution. A toner having such a small particle diameter and a sharp particle diameter distribution is uniformly charged, produces high-quality images with less foggy images and has high transferability.

The volume-average particle diameter and particle diameter distribution of toner can be measured, for example, by an instrument such as Coulter Counter TA-II or Coulter Multisizer II manufactured by Beckman Coulter Inc. Specifically, the number-based particle diameter distribution data and the volume-based particle diameter distribution data are sent to a personal computer via an interface manufactured by Nikkaki Bios Co., Ltd. to be analyzed. The procedure is as follows:

(1) a surfactant serving as a dispersant, preferably 0.1 to 5 ml of a 1% aqueous solution of an alkylbenzenesulfonic acid salt, is added to an electrolyte such as 1% aqueous solution of first class NaCl;

(2) 2 to 20 mg of a sample (toner) to be measured is added into the mixture;

(3) the mixture is subjected to an ultrasonic dispersion treatment for about 1 to 3 minutes; and (4) the dispersion is added to 100 to 200 ml of an aqueous solution of an electrolyte in a beaker so that the mixture includes the particles at a predetermined concentration;

(5) the diluted dispersion is set in the instrument to measure particle diameters of 50,000 particles using an aperture of 100 μm to determine the volume average particle diameter.

In this regard, the following 13 channels are used:

(1) not less than 2.00 μm and less than 2.52 μm;
(2) not less than 2.52 μm and less than 3.17 μm;
(3) not less than 3.17 μm and less than 4.00 μm;
(4) not less than 4.00 μm and less than 5.04 μm;
(5) not less than 5.04 μm and less than 6.35 μm;
(6) not less than 6.35 μm and less than 8.00 μm;
(7) not less than 8.00 μm and less than 10.08 μm;
(8) not less than 10.08 μm and less than 12.70 μm;
(9) not less than 12.70 μm and less than 16.00 μm;
(10) not less than 16.00 μm and less than 20.20 μm;
(11) not less than 20.20 μm and less than 25.40 μm;
(12) not less than 25.40 μm and less than 32.00 μm; and
(13) not less than 32.00 μm and less than 40.30 μm.

Namely, particles having a particle diameter in the range of 2.00 to 40.30 μm are targeted.

In this regard, the volume average particle diameter is obtained by the following equation.

$$\text{Volume average particle diameter}=\Sigma XfV/\Sigma fV,$$

wherein X represent the representative particle diameter of each channel, V represents the volume of the particle having the representative particle diameter, and f represents the number of particles having particle diameters in the channel.

The toner of the present invention can be used for a two-component developer in which the toner is mixed with a magnetic carrier. A content of the toner is preferably from 1 to 10 parts by weight per 100 parts by weight of the carrier.

Specific examples of the magnetic carrier include known carrier materials such as iron powders, ferrite powders, magnetite powders, magnetic resin carriers, which have a particle diameter in the range of about 20 to about 200 μm.

Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins.

An electroconductive powder may optionally be included in the toner. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner.

The toner of the present invention can also be used as a one-component magnetic or non-magnetic developer without a carrier.

<Transfer Process and Transferer>

A transfer process transfers the visual image onto a recording medium. Transferers preferably include a first transferer transferring the visual image onto an intermediate transferer and a second transferer transferring the visual image on the intermediate transferer onto the recording medium. Then, it is preferable that the toners include two or more color toners, preferably full colors, the first transferer transfers the visual image onto the intermediate transferer to form a complex transfer image and the second transferer transfers the complex image onto the recording medium.

The intermediate transferer is not particularly limited, and can be selected according to the purpose from known transferers, e.g., a transfer belt is preferably used.

The transferers, i.e., the first transferer and the second transferer preferably include at least a transfer means separating and charging the visual image formed on the image bearer to a recording medium. The transfer means may be one or two or more. The transfer means include a corona charger using corona discharge, a transfer belt, a transfer roller, a pressure transfer roller, an adhesive transfer means, etc.

The recording medium is typically a plain paper, but is not particularly limited, provided an unfixed image is transferable thereto and can be selected according to the purpose. PET for OHP can also be sued.

The fixing process fixes a toner image transferred onto the recording medium, and may fix each toner (visual) image transferred thereon or layered toner images of each color at one time. A fixer is not particularly limited and can be selected according to the purpose, and known heating and pressing means is preferably used. The heating and pressing means includes a combination of a heat roller and a pressure roller, a combination of a heat roller, a pressure roller and an endless belt. The heating and pressing means preferably heats at 80° C. to 200° C.

<Cleaning Process and Cleaner>

The cleaning process removes the toner remaining on the image bearer, and is performed by a cleaner.

The cleaner includes the cleaning blade.

The cleaning blade preferably contacts the surface of the image bearer at a pressure in the range of 10 to 100 N/m, and more preferably from 10 to 50 N/m. When less than 10 N/m, a toner easily passes through a contact point between the cleaning blade and the image bearer, resulting in incidental defective cleaning. When greater than 100 N/m, the tip ridgeline 62*c* of the cleaning blade occasionally turns up due to increase of frictional force of the contact point.

The pressure can be measured by a measurer installed with a compact compressed load cell from Kyowa Electronic Instruments Co., Ltd.

The cleaning blade preferably contact the image bearer at an angle in the range of 65° to 85°. When less than 65°, the cleaning blade occasionally turns up. When greater than 85°, defective cleaning occasionally occurs.

<Other Processes and Other Means>

The image forming apparatus includes, e.g., a discharger, a recycler, a controller, etc. as other means.

The image forming method includes, e.g., a discharge process, a recycle process, a control process, etc. as other processes.

—Discharge Process and Discharger—

The discharge process applied a discharge bias to the image bearer to be discharged, and preferably performed by a discharger.

The discharger includes, but is not limited to, known dischargers such as discharge lamps.

—Recycle Process and Recycler—

The recycle process is a process of recycling the removed toner in the cleaning process to the image developer, which is performed by the recycler.

The recycler is not particularly limited, and can be selected from known conveyers.

—Control Process and Controller—

The control process is a process of controlling the above-described processes, performed by the controller.

The controller is not particularly limited, and can be selected from controllers such as a sequencer and a computer.

Figure 4:
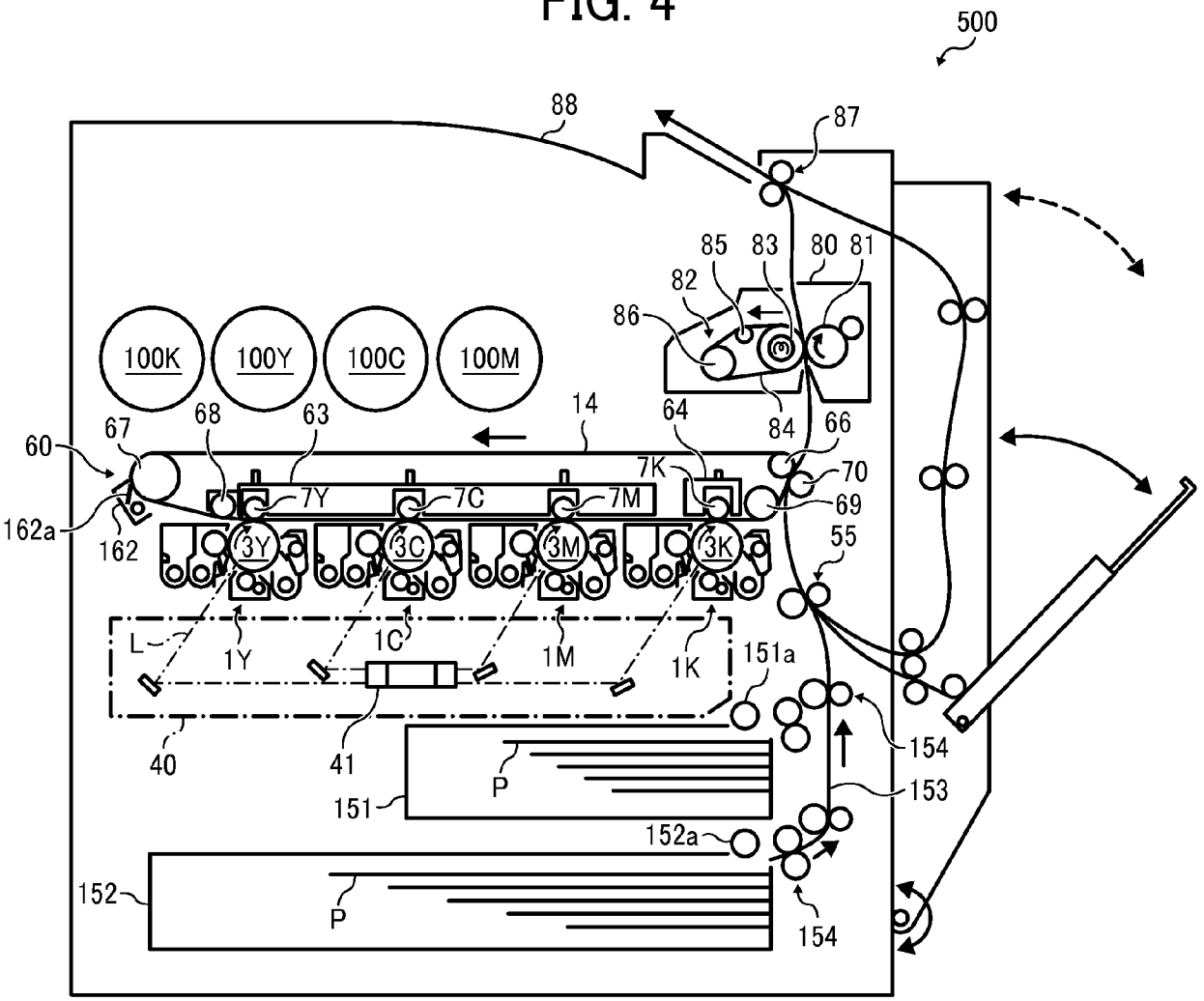
FIG. 4 is a schematic view illustrating an embodiment of the image forming apparatus of the present invention.

An embodiment of the image forming apparatus of the present invention is explained by reference to drawings. FIG. 4 illustrates an electrophotographic printer 500 as embodiment of the image forming apparatus of the present invention. The a printer 500 includes four image forming units, i.e., yellow (Y), cyan (C), magenta (M) and black (K) image forming units 1Y, 1C, 1M and 1K. The four image forming units 1Y, 1C, 1M and 1K have the same configuration except that the color of toner used for developing an electrostatic latent image on a photoreceptor is different.

The printer 500 further includes a transfer unit 60, which includes an intermediate transfer belt 14 and which is located above the four image forming units 1. As mentioned later in detail, Y, C, M and K toner images formed on respective photoreceptors 3Y, 3C, 3M and 3K serving as photoreceptors are transferred onto the surface of the intermediate transfer belt 14 so as to be overlaid, resulting in formation of a combined color toner image on the intermediate transfer belt 14.

In addition, an optical writing unit 40 serving as a latent image former is located below the four image forming units 1. The optical writing unit 40 emits light beams L (such as laser beams) based on Y, C, M and K image information to irradiate the photoreceptors 3Y, 3C, 3M and 3K with the laser beams L, thereby forming electrostatic latent images, which respectively correspond to the Y, C, M and K images to be formed, on the photoreceptors. The optical writing unit 40 includes a polygon mirror 41, which is rotated by a motor and which reflects the light beams L emitted by a light source of the optical writing unit while deflecting the laser beams to irradiate the photoreceptors 3Y, 3C, 3M and 3K with the laser beams L via optical lenses and mirrors. The optical writing unit 40 is not limited thereto, and an optical writing unit using a LED array or the like can also be used therefor.

Below the optical writing unit 40, a first sheet cassette 151, and a second sheet cassette 152 are arranged so that the first sheet cassette is located above the second sheet cassette. Each of the sheet cassettes 151 and 152 contains a stack of paper sheets P serving as a recording material. Uppermost sheets of the paper sheets P in the first and second sheet cassettes 151 and 152 are contacted with a first feed roller 151*a* and a second feed roller 152*a*, respectively. When the first feed roller 151*a* is rotated (counterclockwise in FIG. 4) by a driver (not shown), the uppermost sheet Pin the first sheet cassette 151 is fed by the first feed roller 151*a* toward a sheet passage 153 located on the right side of the printer 500 while extending vertically. Similarly, when the second feed roller 152*a* is rotated (counterclockwise in FIG. 4) by a driver (not shown), the uppermost sheet P in the second sheet cassette 152 is fed by the second feed roller 152*a* toward the sheet passage 153.

Plural pairs of feed rollers 154 are arranged in the sheet passage 153. The paper sheet P fed into the sheet passage 153 is fed from the lower side of the sheet passage 153 to the upper side thereof while being pinched by the pairs of feed rollers 154.

A pair of registration rollers 55 is arranged on the downstream side of the sheet passage 153 relative to the sheet feeding direction. When the pair of registration rollers 55 pinches the tip of the paper sheet P thus fed by the pairs of feed rollers 154, the pair of registration rollers 55 is stopped once, and is then rotated again to timely feed the paper sheet P to a secondary transfer nip mentioned below so that a combined color toner image on the intermediate transfer belt 14 is transferred onto the predetermined position of the paper sheet P.

Figure 5:
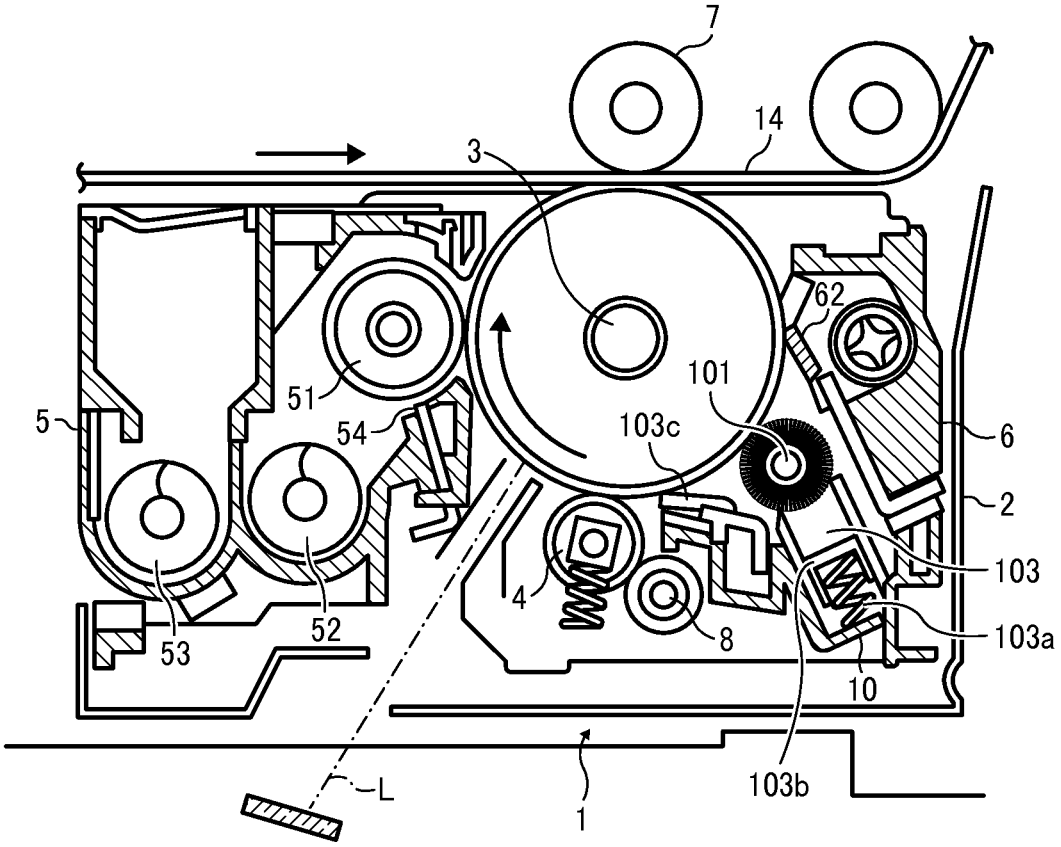
FIG. 5 is a schematic view illustrating an image forming unit of the embodiment of the image forming apparatus illustrated in FIG. 4.

FIG. 5 illustrates one of the four image forming units 1.

As illustrated in FIG. 5, the image forming unit 1 includes a drum-shaped photoreceptor 3 serving as a photoreceptor. The shape of the photoreceptor 3 is not limited thereto, and sheet-shaped photoreceptors, endless belt-shaped photoreceptors and the like can also be used.

Around the photoreceptor 3, a charging roller 4, an image developer 5, a primary transfer roller 7, a cleaner 6, a lubricant applicator 10, a discharging lamp (not shown), etc., are arranged. The charging roller 4 serves as a charger for charging a surface of the photoreceptor 3. The image developer 5 serves as an image developer for developing an electrostatic latent image formed on the photoreceptor 3 with a developer to form a toner image thereon. The primary transfer roller 7 serves as a primary transferer for transferring the toner image on the photoreceptor 3 to the intermediate transfer belt 14. The cleaner 6 serves as a cleaner for removing residual toner from the surface of the photoreceptor 3 after transferring the toner image. The lubricant applicator 10 serves as a lubricant applicator for applying a lubricant to the surface of the photoreceptor 3 after cleaning the surface. The discharging lamp (not shown) serves as a discharger for decaying residual charges remaining on the surface of the photoreceptor 3 after cleaning the surface.

The charging roller 4 is arranged in the vicinity of the photoreceptor 3 with a predetermined gap therebetween, and evenly charges the photoreceptor 3 so that the photoreceptor 3 has a predetermined potential with a predetermined polarity. The thus evenly charged surface of the photoreceptor 3 is irradiated with the light beam L emitted by the optical writing unit 40 based on image information, thereby forming an electrostatic latent image on the surface of the photoreceptor 3.

The image developer 5 has a developing roller 51 serving as a developer bearing member. A development bias is applied to the developing roller 51 by a power source (not shown). A supplying screw 52 and an agitating screw 53 are provided in a casing of the image developer 5 to feed the developer in opposite directions in the casing so that the developer is charged so as to have a charge with a predetermined polarity. In addition, a doctor 54 is provided in the image developer to form a developer layer having a predetermined thickness on the surface of the developing roller 51. The layer of the developer, which has been charged so as to have a charge with the predetermined polarity, is adhered to an electrostatic latent image on the photoreceptor 3 at a development region, in which the developing roller 51 is opposed to the photoreceptor 3, resulting in formation of a toner image on the surface of the photoreceptor 3.

The cleaner 6 includes a fur brush 101, the cleaning blade 62, etc. The cleaning blade 62 is contacted with the surface of the photoreceptor 3 in such a manner as to counter the rotated photoreceptor 3. Details of the cleaning blade 62 will be mentioned later. The lubricant applicator 10 includes a solid lubricant 103, and a pressing spring 103*a* to press the solid lubricant 103 toward the fur brush 101 serving as a lubricant applicator to apply the lubricant to the surface of the photoreceptor 3. The solid lubricant 103 is supported by a bracket 103*b* while being pressed toward the fur brush 101 by the pressing spring 103*a*. The solid lubricant 103 is scraped by the fur brush 101, which is driven by the photoreceptor 3 so as to rotate (counterclockwise in FIG. 5), thereby applying the lubricant 103 to the surface of the photoreceptor 3. By thus applying the lubricant, the friction coefficient of the surface of the photoreceptor 3 can be controlled so as to be not higher than 0.2. The lubricant applied on the photoreceptor 3 is leveled by a levelling blade 103C.

Although the non-contact short-range charging roller 4 is used as the charger of the image forming unit 1, the charger is not limited thereto, and contact chargers (such as contact charging rollers), corotrons, scorotrons, solid state chargers, and the like can also be used for the charger. Among these chargers, contact chargers, and non-contact short-range chargers are preferable because of having advantages such that the charging efficiency is high, the amount of ozone generated in a charging operation is small, and the charger can be miniaturized.

Specific examples of light sources for use in the optical writing unit 40 and the discharging lamp include any known light emitters such as fluorescent lamps, tungsten lamps, halogen lamps, mercury lamps, sodium lamps, light emitting diodes (LEDs), laser diodes (LDs), electroluminescent lamps (ELs), and the like.

In order to irradiate the photoreceptor 3 with light having a wavelength in a desired range, sharp cut filters, bandpass filters, infrared cut filers, dichroic filters, interference filters, color temperature converting filters, and the like can be used.

Among these light sources, LEDs and LDs are preferably used because of having advantages such that the irradiation energy is high, and light having a relatively long wavelength in the range of 600 to 800 nm can be emitted.

The transfer unit 60 serving as a transferer includes not only the intermediate transfer belt 14, but also a belt cleaning unit 162, a first bracket 63, and a second bracket 64. In addition, the transfer units 60 further includes four primary transfer rollers 7Y, 7C, 7M and 7K, a secondary transfer backup roller 66, a driving roller 67, a supplementary roller 68, and a tension roller 69. The intermediate transfer belt 14 is rotated counterclockwise in an endless manner by the driving roller 67 while being tightly stretched by the four rollers. The four primary transfer rollers 7Y, 7C, 7M and 7K press the thus rotated intermediate transfer belt 14 toward the photoreceptors 3Y, 3C, 3M and 3K, respectively, to form four primary transfer nips. In addition, a transfer bias having a polarity opposite that of the charge of the toner is applied to the backside (i.e., inner surface) of the intermediate transfer belt (for example, a positive bias is applied when a negative toner is used). Since the intermediate transfer belt 14 is rotated endlessly, yellow, cyan, magenta and black toner images, which are formed on the photoreceptors 3Y, 3C, 3M and 3K, respectively, are sequentially transferred onto the intermediate transfer belt 14 so as to be overlaid, resulting in formation of a combined 4-color toner image (hereinafter referred to as a 4-color toner image) on the intermediate transfer belt 14.

The secondary transfer backup roller 66 and a secondary transfer roller 70 sandwich the intermediate transfer belt 14 to form a secondary transfer nip. As mentioned above, the pair of registration rollers 55 pinches the transfer paper sheet P once, and then timely feeds the paper sheet P toward the secondary transfer nip so that the combined color toner image on the intermediate transfer belt 14 is transferred onto a predetermined position of the paper sheet P. Specifically, the entire combined color toner image is transferred due to a secondary transfer electric field formed by the secondary transfer roller 70, to which a secondary transfer bias is applied, and the secondary transfer backup roller 66, and a nip pressure applied between the secondary transfer roller 70 and the transfer backup roller 66, resulting in formation of a full color toner image on the paper sheet P having white color.

After passing the secondary transfer nip, the intermediate transfer belt 14 bears residual toners (i.e., non-transferred toners) on the surface thereof. The belt cleaning unit 162 removes the residual toners from the surface of the intermediate transfer belt 14. Specifically, a belt cleaning blade 162*a* of the belt cleaning unit 162 is contacted with the surface of the intermediate transfer belt 14 to remove the residual toners therefrom.

The first bracket 63 of the transfer unit 60 is rotated at a predetermined rotation angle on a rotation axis of the supplementary roller 68 by being driven by an on/off operation of a solenoid (not shown). When a monochromatic image is formed, the printer 500 slightly rotates the first bracket 63 counterclockwise by driving the solenoid. When the first bracket 63 is thus rotated, the primary transfer rollers 7Y, 7C and 7M are moved counterclockwise around the rotation axis of the supplementary roller 68, thereby separating the intermediate transfer belt 14 from the photoreceptors 3Y, 3C and 3M. Thus, only the black image forming unit 1K is operated (without driving the color image forming units 1Y, 1C and 1M) to form a monochromatic image. By using this method, the life of the parts of the color image forming units 1Y, 1C and 1M can be prolonged.

As illustrated in FIG. 4, a fixing unit 80 is provided above the secondary transfer nip. The fixing unit 80 includes a pressure/heat roller 81 having a heat source (such as a halogen lamp) therein, and a fixing belt unit 82. The fixing belt unit 82 includes an endless fixing belt 84 serving as a fixing member, a heat roller 83 having a heat source (such as a halogen lamp) therein, a tension roller 85, a driving roller 86, a temperature sensor (not shown), and the like. The endless fixing belt 84 is counterclockwise rotated endlessly by the driving roller 86 while being tightly stretched by the heat roller 83, the tension roller 85 and the driving roller 86. When the fixing belt 84 is rotated, the fixing belt is heated by the heat roller 83 from the backside thereof. The pressure/heat roller 81 is contacted with the front surface of the fixing belt 84 while pressing the fixing belt 84 to the heat roller 83, resulting in formation of a fixing nip between the pressure/heat roller 81 and the fixing belt 84.

A temperature sensor (not shown) is provided so as to be opposed to the front surface of the fixing belt 84 with a predetermined gap therebetween to detect the temperature of the fixing belt 84 at a location just before the fixing nip. The detection data are sent to a fixing device supply circuit (not shown). The fixing device supply circuit performs ON/OFF control on the heat source in the heat roller 83 and the heat source in the pressure/heat roller 81.

The transfer paper sheet P passing the secondary transfer nip and separated from the intermediate transfer belt 14 is fed to the fixing unit 80. When the paper sheet P bearing the unfixed full color toner image thereon is fed from the lower side of the fixing unit 80 to the upper side thereof while being sandwiched by the fixing belt 14 and the pressure/heat roller 81, the paper sheet P is heated by the fixing belt 84 while being pressed by the pressure/heat roller 81, resulting in fixation of the full color toner image on the paper sheet P.

The paper sheet P thus subjected to a fixing treatment is discharged from the main body of the printer 500 by a pair of discharging rollers 87 so as to be stacked on a surface of a stacking portion 88.

Four toner cartridges 100Y, 100C, 100M and 100K respectively containing yellow, cyan, magenta and black color toners are provided above the transfer unit 60 to supply the yellow, cyan, magenta and black color toners to the corresponding image developers 5Y, 5C, 5M and 5K of the image forming units 1Y, 1C, 1M and 1K, if desired. These toner cartridges 100Y, 100C, 100M and 100K are detachable from the main body of the printer 500 independently of the image forming units 1Y, 1C, 1M and 1K.

Next, the image forming operation of the printer 500 is explained.

Upon receipt of a print execution signal from an operating portion (not shown) such as an operation panel, predetermined voltages or currents are applied to the charging roller 4 and the developing roller 51 at predetermined times. Similarly, predetermined voltages or currents are applied to the light sources of the optical writing unit 40 and the discharging lamp. In synchronization with these operations, the photoreceptors 3 are rotated in a direction indicated by an arrow by a driving motor (not shown).

When the photoreceptors 3 are rotated, the surfaces thereof are charged by the respective charging rollers 4 so as to have predetermined potentials. Next, light beams L (such as laser beams) emitted by the optical writing unit 40 irradiate the charged surfaces of the photoreceptors 3 to be discharged, thereby forming electrostatic latent images on the surface of the photoreceptors 3.

The surfaces of the photoreceptors 3 bearing the electrostatic latent images are rubbed by magnetic brushes of the respective developers formed on the respective developing rollers 51. In this case, the (negatively-charged) toners on the developing rollers 51 are moved toward the electrostatic latent images by the development biases applied to the developing rollers 51, resulting in formation of color toner images on the surface of the photoreceptors 3Y, 3C, 3M and 3K.

Thus, each of the electrostatic latent images formed on the photoreceptors 3 is subjected to a reverse development treatment using a negative toner. In this example, an N/P (negative/positive: a toner adheres to a place having lower potential) developing method using a non-contact charging roller is used, but the developing method is not limited thereto.

The color toner images formed on the surfaces of the photoreceptors 3Y, 3C, 3M and 3K are primarily transferred to the intermediate transfer belt 14 so as to be overlaid, thereby forming a combined color toner image on the intermediate transfer belt 14.

The 4-color toner image thus formed on the intermediate transfer belt 14 is transferred onto a predetermined portion of the paper sheet P, which is fed from the first or second cassette 151 or 152 and which is timely fed to the secondary transfer nip by the pair of registration rollers 55 after being pinched thereby. After the paper sheet P bearing the combined color toner image thereon is separated from the intermediate transfer belt 14, the paper sheet P is fed to the fixing unit 80. When the paper sheet P bearing the combined color toner image thereon passes the fixing unit 80, the combined toner image is fixed to the paper sheet P upon application of heat and pressure thereto. The paper sheet P bearing the fixed combined color toner image (i.e., a full color image) thereon is discharged from the main body of the printer 500, resulting in stacking on the surface of the stacking portion 88.

Toners remaining on the surface of the intermediate transfer belt 14 even after the combined color toner image thereon is transferred to the paper sheet P are removed therefrom by the belt cleaning unit 162.

Toners remaining on the surfaces of the photoreceptors 3 even after the color toner images thereon is transferred to the intermediate transfer belt 14 are removed therefrom by the cleaner 6. Further, the surfaces of the photoreceptors 3 are coated with a lubricant by the lubricant applicator 10, followed by a discharging treatment using a discharging lamp.

As illustrated in FIG. 5, the photoreceptor 3, the charging roller 4, the developing device 5, the cleaner 6, the lubricant applicator 10, and the like are contained in a case 2 of the image forming unit 1 of the printer 500. The image forming unit 10 is detachable attachable to the main body of the printer 500 as a single unit (i.e., process cartridge). However, the image forming unit 1 is not limited thereto, and may have a configuration such that each of the members and devices such as the photoreceptor 3, charging roller 4, developing device 5, cleaner 6, and lubricant applicator 10 is replaced with a new member or device.

A toner used in the printer 500 preferably has a high circularity and a small particle diameter. Such a toner can be preferably prepared by polymerization methods such as suspension polymerization methods, emulsion polymerization methods, dispersion polymerization methods, and the like. The toner preferably has an average circularity not less than 0.97, and a volume-average particle diameter not greater than 5.5 μm to produce higher resolution images.

Even when attempting to remove such a polymerization toner from the surface of the photoreceptor 3 with the cleaning blade 62 like a conventional pulverization toner, the toner is not sufficiently removed therefrom, resulting in poor cleaning. This is because the polymerization toner having a high circularity and a small particle diameter enters a slight gap between the cleaning blade 62 and the photoreceptor 3, and scrapes off from the gap.

Figure 6A:
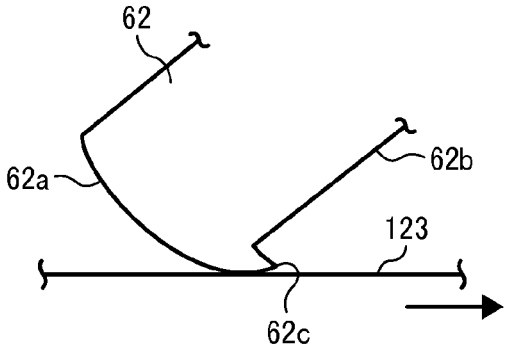
FIGS. 6A to 6C are schematic views for explaining how a cleaning blade is damaged.
Figure 6B:
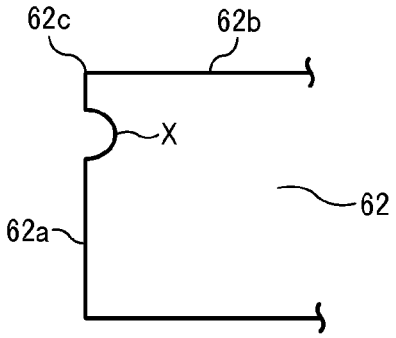
Figure 6C:
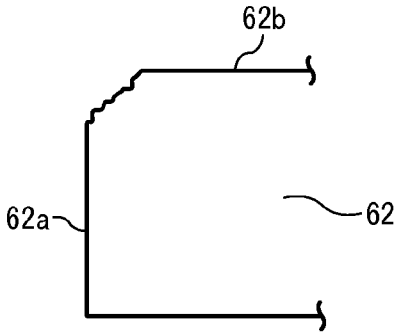

A contact pressure between the image bearer and the cleaning blade needs increasing to prevent the toner from scraping from the gap. However, when the contact pressure is increased, a friction between an image bearer 3 and a cleaning blade 62 in FIG. 6A increases, the cleaning blade 62 is drawn in a travel direction of the image bearer, and a tip ridgeline 62*c* of the cleaning blade 62 turns up. The cleaning blade 62 turned up occasionally makes noises when restored to its original state, resisting turning up. Further, when the cleaning continues while the tip ridgeline 62*c* of the cleaning blade 62 is turned up, a local abrasion is made a few μm from the tip ridgeline 62*c* of an edge surface 62*a* of the cleaning blade 62 as shown in FIG. 6B. When the cleaning continues further, the local abrasion becomes large and finally the tip ridgeline 62*c* is chipped as shown in FIG. 6C. When the tip ridgeline 62*c* lacks, a toner cannot normally be removed, resulting in poor cleaning.

Figure 7A:
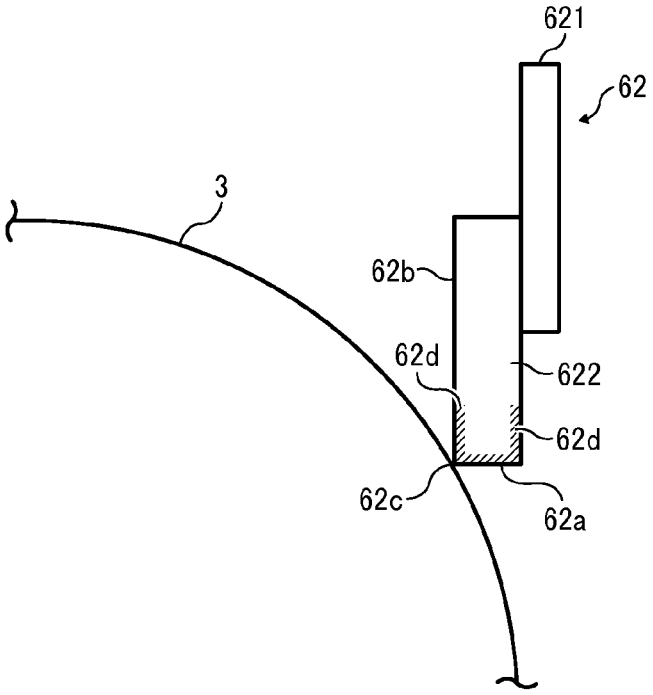
FIGS. 7A and B are schematic cross-sectional views illustrating an example of the cleaning blade of this disclosure.
Figure 7B:
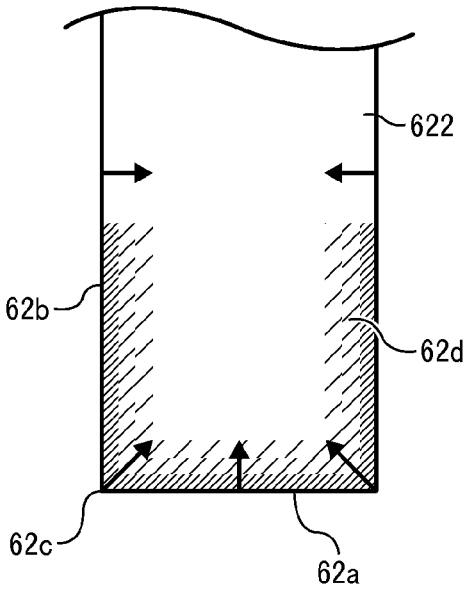

FIGS. 7A and 7B are schematic cross-sectional views illustrating an embodiment of the cleaning blade of the present invention, and FIG. 7A shows the cleaning blade contacts the surface of the photoreceptor 3 and FIG. 7B is an amplified view of the tip ridgeline 62*c* of the cleaning blade 62.

The cleaning blade 62 includes a plate-shaped holder 621 which is made of a rigid material such as metals and hard plastics, and a plate-shaped elastic blade 622. The elastic blade 622 is fixed with an adhesive on an end of the holder 621, and the other end thereof is cantileverly supported by a case of the cleaner 6.

As FIG. 7A shows, the cleaning blade 62 is located such that the tip ridgeline 62*c* that is a free end of the elastic blade 622 contacts the surface of the photoreceptor 3 in a longitudinal direction thereof.

The elastic blade 622 preferably has high impact resilience coefficient so as to follow eccentricity or slight surface undulation of the photoreceptor 3, and is preferably formed of a urethane rubber. The urethane rubber of the elastic blade 622 preferably has a JIS-A hardness in the range of not less than 60°.

The tip ridgeline 62*c* of the elastic blade 622 is impregnated with the cured material of the UV curable composition including the acrylate or methacrylate compound having an alicyclic structure including 6 or more carbon atoms in its molecule, preferably the acrylate or methacrylate compound having a tricyclodecane structure or an adamantane structure.

The tip ridgeline 62*c* is impregnated with the cured material of the UV curable composition including the acrylate or methacrylate compound having an alicyclic structure including 6 or more carbon atoms in its molecule. Then, UV light is irradiated thereto to form an impregnated part 62*d* in FIG. 7B and the tip ridgeline 62*c* has higher hardness to improve durability. This prevents the elastic blade 622 from deforming in a travel direction of the photoreceptor 3.

The elastic blade 622 preferably has an impact resilience coefficient in the range of 40% to 60% at 23° C., and the tip ridgeline 62*c* preferably has an impact resilience coefficient in the range of 50% to 80%.

In addition, there is a cleaning blade having an impregnated ridge line covered with a high-hardness surface layer to further increase abrasion resistance. However, the surface layer possibly cracks or peels. The cleaning blade 62 of the embodiment has no surface layer, which is free from cracks or peels.

<Process Cartridge>

A process cartridge includes at least the photoreceptor 3 as an image bearer and a cleaner removing a toner remaining thereon, and other means when necessary.

The cleaner include the cleaning blade.

The process cartridge of the embodiment is a component detachable from an image forming apparatus, including the photoreceptor 3 and the cleaning blade, and at least one of a charger, an irradiator, an image developer, a transferer and a discharger.

Hereinafter, verification experiments made by the applicant are explained.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

[Verification Experiment 1]

Materials of the elastic member 622, impregnation methods and impregnation materials were differentiated to make durability test.

Two elastic members having JIS-A hardness and impact resilience coefficient different from each other were used.

—Preparation of Elastic Member No. 1—

According to a method of preparing cleaning blade disclosed in Example 1 of Japanese published unexamined application No. JP-2011-141449-A, a plate-shaped elastic member No. 1 having an average thickness of 1.8 mm and a size of 11.5 mm×32.6 mm was prepare.

The elastic member No. 1 had a JIS-A hardness of 68° and an impact reliance coefficient of 30%.

—Preparation of Elastic Member No. 2—

According to a method of preparing cleaning blade disclosed in Example 2 of Japanese published unexamined application No. JP-2011-141449-A, a plate-shaped and double-layered cleaning blade 2 having an average thickness of 1.8 mm and a size of 11.5 mm×32.6 mm was prepare.

The double-layered cleaning blade 2 had a JIS-A hardness of 80° at the contact side surface, 75° at the other surface side and an impact reliance coefficient of 30%.

The JIS-A hardness was measured by micro rubber durometer MD-1 from KOBUNSHI KEIKI CO., LTD. according to JIS K6253.

The impact reliance coefficient was measured by a resilience tester No. 221 from Toyo Seiki Seisaku-sho, Ltd. according to JIS K6255. Two sheets having a thickness about 2 mm of the sample to be measured were layered to have a thickness not less than 4 mm.

The UV curable composition impregnated in the tip ridgeline 62*c* of the elastic member is explained.

—Preparation of UV Curable Composition 1—

A UV curable composition 1 was prepared by routine procedure with the following formula.

Tricyclodecane Dimethanol Diacrylate 50

A-DCP from Shin-Nakamura Chemical Co., Ltd., having two functional groups, a molecular weight of 304 and the following formula.

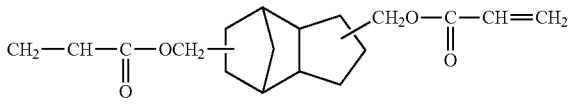

| | |
|---|---|
| Polymerization initiator: Irgacure 184 from Ciba Specialty Chemicals | 5 |
| Solvent: Cyclohexanone | 55 |

—Preparation of UV Curable Composition 2—

A UV curable composition 2 was prepared by routine procedure with the following formula.

Acrylate or Methacrylate Compound Having an Adamantane Structure 1 50

X-DA from Idemitsu Kosan Co., Ltd., which is a reactant between 1,3-adamantane diol and acrylic acid having two functional groups, a molecular weight in the range of 276 to 304 and the following formula.

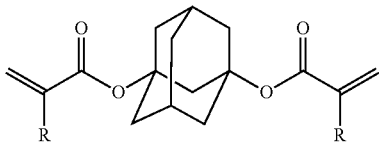

(R = H, $CH_3$)

wherein R represents a hydrogen atom or a methyl group.

| | |
|---|---|
| Polymerization initiator: Irgacure 184 from Ciba Specialty Chemicals | 5 |
| Solvent: Cyclohexanone | 55 |

—Preparation of UV Curable Composition 3—

A UV curable composition 3 was prepared by routine procedure with the following formula.

Acrylate or Methacrylate Compound Having an Adamantane Structure 2 50

X-A-201 1,3-adamantane dimethanol diacrylate from Idemitsu Kosan Co., Ltd., having two functional groups, a molecular weight of 304 and the following formula.

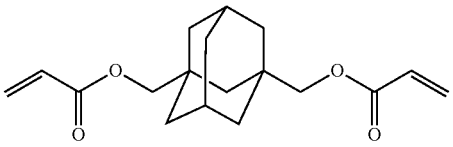

| | |
|---|---|
| Polymerization initiator: Irgacure 184 from Ciba Specialty Chemicals | 5 |
| Solvent: Cyclohexanone | 55 |

—Preparation of UV Curable Composition 4—

A UV curable composition 4 was prepared by routine procedure with the following formula.

| | |
|---|---|
| acrylate or methacrylate compound having an adamantane structure 3 | 50 |

Diapurest ADTM from Mitsubishi Gas Chemical Company, Inc. having two functional groups, a molecular weight of 388 and the following formula.

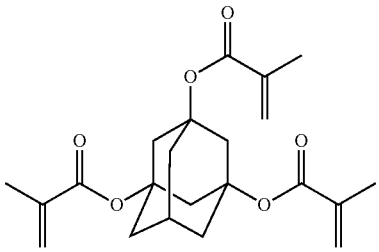

| | |
|---|---|
| Polymerization initiator: Irgacure 184 from Ciba Specialty Chemicals | 5 |
| Solvent: Cyclohexanone | 55 |

—Preparation of UV Curable Composition 5—

A UV curable composition 5 was prepared by routine procedure with the following formula.

| | |
|---|---|
| Tricyclodecane dimethanol diacrylate | 25 |

A-DCP from Shin-Nakamura Chemical Co., Ltd., having two functional groups, a molecular weight of 304 and the above formula.

| | |
|---|---|
| Pentaerythritoltriacrylate | 25 |

PETIA from DAICEL-CYTEC Co., Ltd., having three functional groups, a molecular weight of 298 and the following formula.

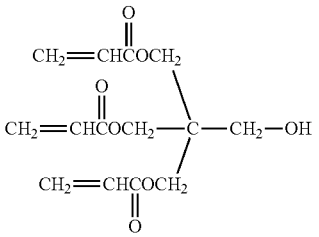

| | |
|---|---|
| Polymerization initiator: Irgacure 184 from Ciba Specialty Chemicals | 5 |
| Solvent: Cyclohexanone | 55 |

—Preparation of UV Curable Composition 6—

A UV curable composition 6 was prepared by routine procedure with the following formula.

Acrylate or Methacrylate Compound Having an Adamantane Structure 2 25

X-A-201 1,3-adamantane dimethanol diacrylate from Idemitsu Kosan Co., Ltd., having two functional groups, a molecular weight of 304 and the above formula.

| | |
|---|---|
| Pentaerythritoltriacrylate | 25 |

PETIA from DAICEL-CYTEC Co., Ltd. having three functional groups and a molecular weight of 298, and the above formula:

| | |
|---|---|
| Polymerization initiator: Irgacure 184 from Ciba Specialty Chemicals | 5 |
| Solvent: Cyclohexanone | 55 |

—Preparation of UV Curable Composition 7—

A UV curable composition 7 was prepared by routine procedure with the following formula.

| | |
|---|---|
| Pentaerythritoltriacrylate | 50 |

PETIA from DAICEL-CYTEC Co., Ltd., having three functional groups, a molecular weight of 298 and the above formula.

| | |
|---|---|
| Polymerization initiator: Irgacure 184 from Ciba Specialty Chemicals | 5 |
| Solvent: Cyclohexanone | 55 |

—Preparation of UV Curable Composition 8—

A UV curable composition 8 was prepared by routine procedure with the following formula.

Dipentaerythritol Hexane Acrylate 59

DPHA from Daicel-Cytec Company, Ltd., having six functional groups, a molecular weight of 578 and the following formula.

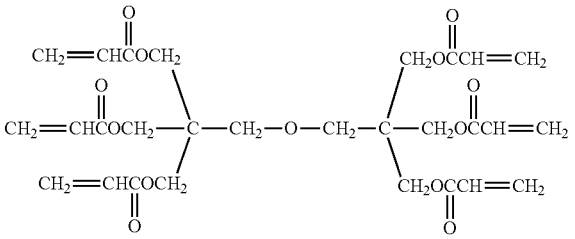

| | |
|---|---|
| Polymerization initiator: Irgacure 184 from Ciba Specialty Chemicals | 5 |
| Solvent: Cyclohexanone | 55 |

<Toner Preparation Example>

Base toner particles having a circularity of 0.98 and an average particle diameter of 4.9 μm were prepared by a polymerization method. One hundred (100) parts of the base toner particles, 1.5 parts of silica having a small particle diameter H2000 from Clariant (Japan) K.K., 0.5 parts of titanium oxide MT-150AI from Tayca Corp., and 1.0 part of silica having a large particle diameter UFP-30H from DENKI KAGAKU KOGYO KABUSHIKI KAISHA were stirred and mixed to prepare a toner.

Reference Example 1

Preparation of Cleaning Blade 1

The tip ridgeline and a depth of 2 mm therefrom of the elastic member No. 1 were dipped in a liquid diluted with a diluent (cyclohexanone) in which the UV curable composition 1 had a solid concentration of 50% by weight for 2 hrs and air-dried for 3 min. After air-dried, the tip ridgeline was irradiated with UV at 140 W/cm×5 m/min×5 passes by UVC-2534/1MNLC3 from Ushio Inc., and dried at 100° C. for 15 min by a heat drier to prepare a cleaning blade 1.

Next, the cleaning blade 1 was fixed on a metal plate holder with an adhesive.

Reference Examples 2 to 6 and Reference Comparative Examples 1 to 3

Preparations of Cleaning Blades 2 to 6 and 9 to 11

The procedure for preparation of the cleaning blade 1 in Reference Example 1 was repeated to prepare cleaning blades 2 to 6 and 9 to 11 except for replacing the UV curable composition 1 with UV curable compositions shown in Table 2.

Reference Examples 7 and 8

Preparations of Cleaning Blades 7 and 8

The procedure for preparation of the cleaning blade 1 in Reference Example 1 was repeated to prepare cleaning blades 7 and 8 except for replacing the elastic member No. 1 and the UV curable composition 1 with elastic members shown n Table 1 and UV curable compositions shown in Table 2. The double-layered cleaning blade includes two laminated rubbers having different properties as mentioned above. The rubber contacting an image bearer has higher hardness.

The elastic members and the UV curable compositions used in Reference Examples 1 to 8 and Reference Comparative Examples 1 to 3 are shown in Table 1 and 2, respectively.

TABLE 1

| | | Elastic Member | | | |
|---|---|---|---|---|---|
| | Cleaning Blade No. | No. | Structure | JIS-A Hardness | Impact Resilience Coefficient |
| Reference Example 1 | Cleaning Blade 1 | 1 | Single Layered | 68° | 30% |
| Reference Example 2 | Cleaning Blade 2 | | | | |
| Reference Example 3 | Cleaning Blade 3 | 1 | Single Layered | 68° | 30% |
| Reference Example 4 | Cleaning Blade 4 | 1 | Single Layered | 68° | 30% |
| Reference Example 5 | Cleaning Blade 5 | 1 | Single Layered | 68° | 30% |
| Reference Example 6 | Cleaning Blade 6 | 1 | Single Layered | 68° | 30% |
| Reference Example 7 | Cleaning Blade 7 | 2 | Double Layered | 80° + 75° | 25% |
| Reference Example 8 | Cleaning Blade 8 | 2 | Double Layered | 80° + 75° | 25% |
| Comparative Reference Example 1 | Cleaning Blade 9 | 1 | Single Layered | 68° | 30% |
| Comparative Reference Example 2 | Cleaning Blade 10 | 1 | Single Layered | 68° | 30% |
| Comparative Reference Example 3 | Cleaning Blade 11 | 1 | Single Layered | 68° | 30% |

TABLE 2

| | UV Curable Composition | | | | |
|---|---|---|---|---|---|
| | No. | Polymerizable Monomer 1 | Polymerizable Monomer 2 | Polymerization Initiator | Solvent |
| Reference Example 1 | 1 | Tricyclodecane dimethanol diacrylate | — | Irgacure 184 | Cyclohexanone |
| Reference Example 2 | 2 | acrylate or methacrylate compound having an adamantane structure 1 | — | Irgacure 184 | Cyclohexanone |
| Reference Example 3 | 3 | acrylate or methacrylate compound having an adamantane structure 2 | — | Irgacure 184 | Cyclohexanone |
| Reference Example 4 | 4 | acrylate or methacrylate compound having an adamantane structure 3 | — | Irgacure 184 | Cyclohexanone |
| Reference Example 5 | 5 | Tricyclodecane dimethanol diacrylate | Pentaerythritol triacrylate | Irgacure 184 | Cyclohexanone |

TABLE 2-continued

| | UV Curable Composition | | | | |
|---|---|---|---|---|---|
| | No. | Polymerizable Monomer 1 | Polymerizable Monomer 2 | Polymerization Initiator | Solvent |
| Reference Example 6 | 6 | acrylate or methacrylate compound having an adamantane structure 2 | Pentaerythritol triacrylate | Irgacure 184 | Cyclohexanone |
| Reference Example 7 | 1 | Tricyclodecane dimethanol diacrylate | — | Irgacure 184 | Cyclohexanone |
| Reference Example 8 | 2 | acrylate or methacrylate compound having an adamantane structure 1 | — | Irgacure 184 | Cyclohexanone |
| Comparative Reference Example 1 | | | None | | |
| Comparative Reference Example 2 | 7 | Pentaerythritol triacrylate | — | Irgacure 184 | Cyclohexanone |
| Comparative Reference Example 3 | 8 | Pentaerythritol triacrylate | — | Irgacure 184 | Cyclohexanone |

Each of the cleaning blades 1 to 11 were installed in color complex machine imagio MP C45001 from Ricoh Company, Ltd. at a predetermined penetration quantity (linear pressure) and a predetermined cleaning angle. The linear pressure and the cleaning angle depend on the cleaning blades.

Ten thousand (10,000) images (A4) of a chart having an image area ratio of 5% were produced at 3 print/job, 21° C. and 65% RH with the above toner. Then, turn-up quantity at the contact point, cleanability and abrasion quantity of the tip ridgeline were evaluated. The results are shown in Table 3.

<Turn-Up Quantity>

The cleaning blade was frictionized on a glass plate coated with a material used in the surface layer of a photoreceptor at the predetermined penetration quantity (linear pressure) and cleaning angle to observe contact status of the cleaning blade from the back of the glass plate. A turn-up length of the tip ridgeline of the cleaning blade was measured using an image produced from a CCD camera CM-5 from Nikon Corp.

<Cleanability>

After 10,000 images were produced, 20 images having three vertical (in a travel direction) stripe images each having a width of 43 mm were produced, the stripe images were visually observed to evaluate cleanability under the following standard. Abnormal images include stripe or zone images, and white spot images.

Good: No abnormal images

Poor: Abnormal images were produced

<Abrasion Quantity>

Figure 8:
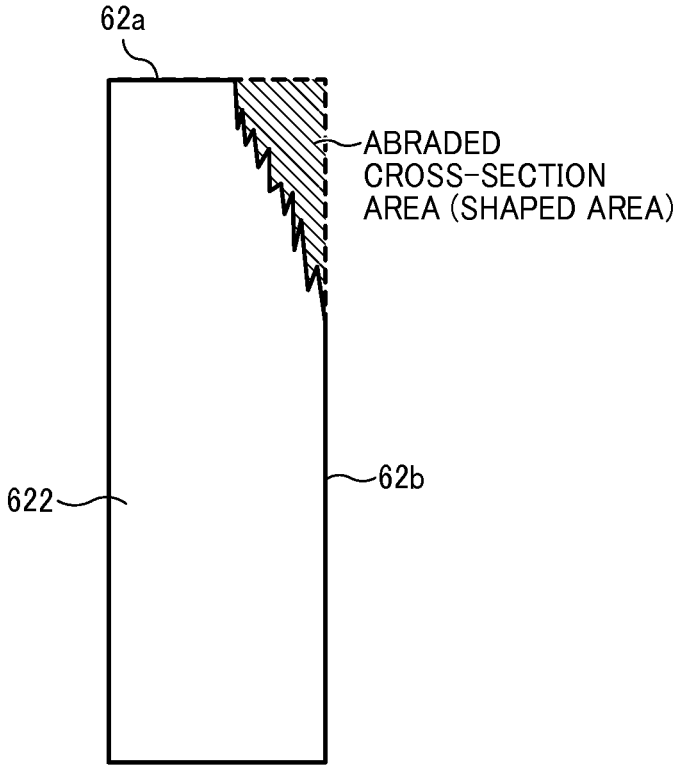
FIG. 8 is a schematic view for explaining the way to determine an abraded portion of the cleaning blade.

After 10,000 images were produced, the abrasion quantity (abrasion width seen from the tip surface of the cleaning blade as shown in FIG. 8) of the cleaning blade contacting the glass plate was measured by a laser microscope VK-9510 from Keyence Corp.

TABLE 3

| | Cleanability | Turn-up Qty. (μm) | Abrasion Qty. (μm) |
|---|---|---|---|
| Reference Example 1 | Good | 0 | 4 |
| Reference Example 2 | Good | 0 | 8 |
| Reference Example 3 | Good | 0 | 3 |
| Reference Example 4 | Good | 0 | 3 |
| Reference Example 5 | Good | 0 | 4 |
| Reference Example 6 | Good | 0 | 4 |
| Reference Example 7 | Good | 0 | 4 |
| Reference Example 8 | Good | 0 | 4 |
| Comparative Reference Example 1 | Poor | 10 | Unmeasurable |
| Comparative Reference Example 2 | Poor | 4 | Unmeasurable |
| Comparative Reference Example 3 | Poor | 6 | Unmeasurable |

Table 3 proves each of Reference Examples 1 to 8 in which the tip ridgeline of the cleaning blade is impregnated with a cured compound comprising an acrylate or methacrylate compound having an alicyclic structure including 6 or more carbon atoms in its molecule had a turn-up quantity of 0 mm. The cleanability was good as well, and all of the cleaning blades had an abrasion quantity not larger than 10 μm.

Next, durability test was made on each of Reference Examples 1 to 8 and Reference Comparative Examples 1 to 3 in low-temperature environment. The results are shown in Table 4.

TABLE 4

| | Cleanability | Cleanability in Low-Temperature Environment | Elastic Power [%] |
|---|---|---|---|
| Reference Example 1 | Good | Poor | 46 |
| Reference Example 2 | Good | Poor | 45 |
| Reference Example 3 | Good | Poor | 44 |
| Reference Example 4 | Good | Poor | 48 |
| Reference Example 5 | Good | Poor | 46 |
| Reference Example 6 | Good | Poor | 44 |
| Reference Example 7 | Good | Poor | 48 |
| Reference Example 8 | Good | Poor | 45 |
| Comparative Reference Example 1 | Poor | Poor | 45 |
| Comparative Reference Example 2 | Poor | Poor | 46 |
| Comparative Reference Example 3 | Poor | Poor | 47 |

The elastic power was measured by a microscopic hardness meter HM-2000 from Fischer Instruments. When a multiplied stress when Vickers indenter was pushed into is Wplast and the multiplied stress when a test load was unloaded is Welast, the elastic power was Welast/Wplast×100%.

As Table 4 shows, Reference Examples 1 to 8 having good cleanability in normal temperature environment had defective cleaning, resulting in production of abnormal images.

[Verification Experiment 2]

Next, elastic members having different impact resilience coefficients were impregnated to prepare cleaning blades including highly-hardened tip ridgelines having elastic powers in the range of 40% to 90%.

—Preparation of Elastic Member No. 3—

The procedure for preparation of the elastic member No. 1 was repeated to prepare a plate-shaped elastic member No. 3 having an average thickness of 1.8 mm and a size of 11.5 mm×32.6 mm. The elastic member No. 3 had an impact reliance coefficient of 40% at 23° C.

—Preparation of Elastic Member No. 4—

The procedure for preparation of the elastic member No. 1 was repeated to prepare a plate-shaped elastic member No. 4 having an average thickness of 1.8 mm and a size of 11.5 mm×32.6 mm. The elastic member No. 4 had an impact reliance coefficient of 42% at 23° C.

—Preparation of Elastic Member No. 5—

The procedure for preparation of the elastic member No. 1 was repeated to prepare a plate-shaped elastic member No. 5 having an average thickness of 1.8 mm and a size of 11.5 mm×32.6 mm. The elastic member No. 5 had an impact reliance coefficient of 45% at 23° C.

—Preparation of Elastic Member No. 6—

The procedure for preparation of the elastic member No. 1 was repeated to prepare a plate-shaped elastic member No. 6 having an average thickness of 1.8 mm and a size of 11.5 mm×32.6 mm. The elastic member No. 6 had an impact reliance coefficient of 50% at 23° C.

—Preparation of Elastic Member No. 7—

The procedure for preparation of the elastic member No. 1 was repeated to prepare a plate-shaped elastic member No. 7 having an average thickness of 1.8 mm and a size of 11.5 mm×32.6 mm. The elastic member No. 7 had an impact reliance coefficient of 53% at 23° C.

—Preparation of Elastic Member No. 8—

The procedure for preparation of the elastic member No. 1 was repeated to prepare a plate-shaped elastic member No. 8 having an average thickness of 1.8 mm and a size of 11.5 mm×32.6 mm. The elastic member No. 8 had an impact reliance coefficient of 58% at 23° C.

—Preparation of Elastic Member No. 9—

The procedure for preparation of the elastic member No. 1 was repeated to prepare a plate-shaped elastic member No. 9 having an average thickness of 1.8 mm and a size of 11.5 mm×32.6 mm. The elastic member No. 9 had an impact reliance coefficient of 60% at 23° C.

—Preparation of Elastic Member No. 10—

The procedure for preparation of the elastic member No. 1 was repeated to prepare a plate-shaped elastic member No. 10 having an average thickness of 1.8 mm and a size of 11.5 mm×32.6 mm. The elastic member No. 10 had an impact reliance coefficient of 35% at 23° C.

—Preparation of Elastic Member No. 11—

The procedure for preparation of the elastic member No. 1 was repeated to prepare a plate-shaped elastic member No. 11 having an average thickness of 1.8 mm and a size of 11.5 mm×32.6 mm. The elastic member No. 11 had an impact reliance coefficient of 30% at 23° C.

—Preparation of Elastic Member No. 12—

The procedure for preparation of the elastic member No. 1 was repeated to prepare a plate-shaped elastic member No. 12 having an average thickness of 1.8 mm and a size of 11.5 mm×32.6 mm. The elastic member No. 12 had an impact reliance coefficient of 90% at 23° C.

Example 1

The tip ridgeline and a depth of 2 mm therefrom of the elastic member No. 1 were dipped in a liquid diluted with a diluent (cyclohexanone) in which the UV curable composition including acrylate or methacrylate compound having an adamantane structure had a solid concentration of 50% by weight for 2 hrs and air-dried for 3 min. After air-dried, the tip ridgeline was irradiated with UV at 140 W/cm×5 m/min×5 passes by UVC-2534/1MNLC3 from Ushio Inc., and dried at 100° C. for 15 min by a heat drier to prepare a cleaning blade.

Next, the cleaning blade was fixed on a metal plate holder with an adhesive. The tip ridgeline had an elastic power of 80%.

Example 2

The procedure for preparation of the cleaning blade in Examples 1 was repeated except for replacing the elastic member No. 1 with the elastic member No. 3. The tip ridgeline had an elastic power of 75%.

Example 3

The procedure for preparation of the cleaning blade in Examples 1 was repeated except for replacing the elastic member No. 1 with the elastic member No. 4. The tip ridgeline had an elastic power of 70%.

Example 4

The procedure for preparation of the cleaning blade in Examples 1 was repeated except for replacing the elastic member No. 1 with the elastic member No. 5. The tip ridgeline had an elastic power of 66%.

Example 5

The procedure for preparation of the cleaning blade in Examples 1 was repeated except for replacing the elastic member No. 1 with the elastic member No. 6. The tip ridgeline had an elastic power of 60%.

Example 6

The procedure for preparation of the cleaning blade in Examples 1 was repeated except for replacing the elastic member No. 1 with the elastic member No. 7. The tip ridgeline had an elastic power of 55%.

Example 7

The procedure for preparation of the cleaning blade in Examples 1 was repeated except for replacing the elastic member No. 1 with the elastic member No. 8. The tip ridgeline had an elastic power of 50%.

Comparative Example 1

The procedure for preparation of the cleaning blade in Examples 1 was repeated except for replacing the elastic member No. 1 with the elastic member No. 10. The tip ridgeline had an elastic power of 45%.

Comparative Example 2

The procedure for preparation of the cleaning blade in Examples 1 was repeated except for replacing the elastic member No. 1 with the elastic member No. 11. The tip ridgeline had an elastic power of 40%.

Comparative Example 3

The procedure for preparation of the cleaning blade in Examples 1 was repeated except for replacing the elastic member No. 1 with the elastic member No. 12. The tip ridgeline had an elastic power of 90%.

Each of the cleaning blades prepared in Examples 1 to 7 and Comparative Examples 1 to 3 were installed in color complex machine imagio MP C45001 from Ricoh Company, Ltd. at a predetermined penetration quantity (linear pressure) and a predetermined cleaning angle. The linear pressure and the cleaning angle depend on the cleaning blades.

Figure 9:
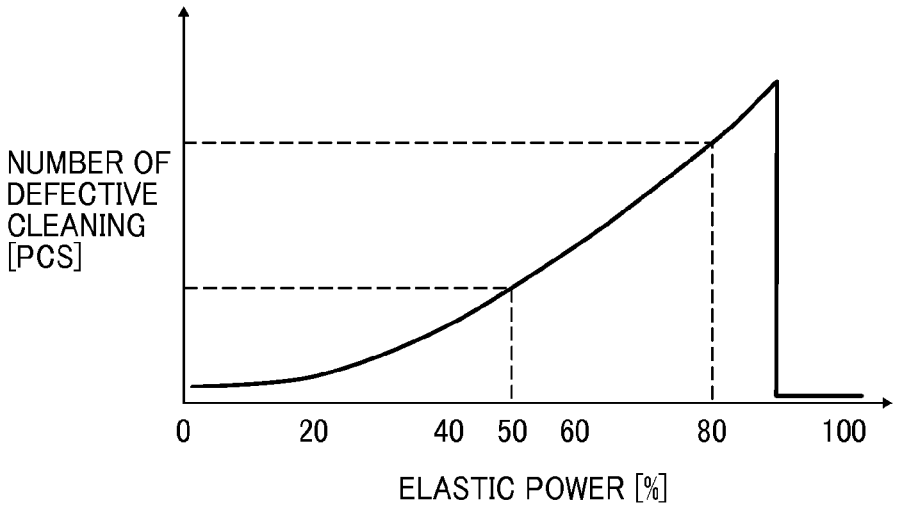
FIG. 9 is a diagram showing relationship between an elastic power and the number of pieces having defective cleaning to reveal the result of the verification experiment 2.

Images (A4) of a chart having an image area ratio of 5% were continuously produced with the same toner in Verification Experiment 1 in low-temperature environment to evaluate cleanability. The results are shown in Table 5. FIG. 9 is a diagram showing the result of Verification Experiment 2, in which the horizontal axis is elastic power and the vertical axis is the number of images having defective cleaning.

Figure 10:
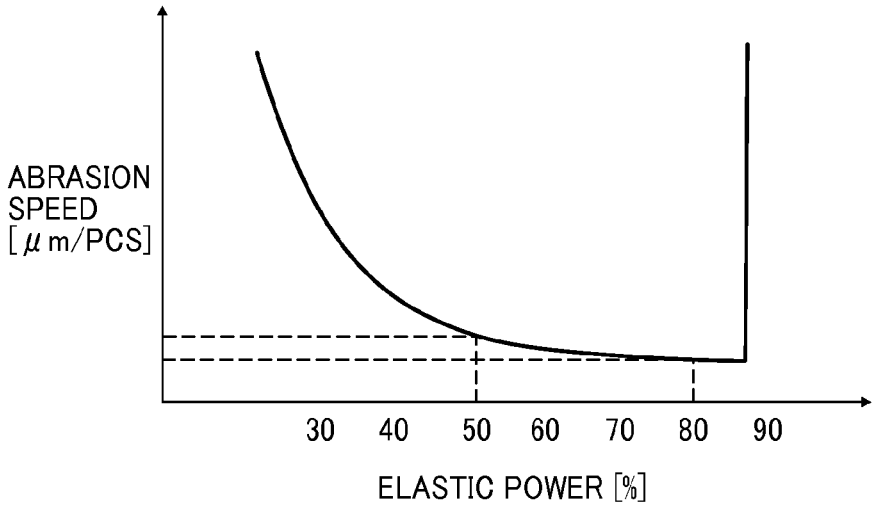
FIG. 10 is a diagram showing relationship between an elastic power and an abrasion speed to reveal the result of the verification experiment 2.

In addition, after defective cleaning occurred, the cleaning blade was removed to measure the abrasion quantity to determine abrasion speed [μm/pieces]. The abrasion quantity was measured by the same way in Verification Experiment 1. FIG. 10 is a diagram showing the result of Verification Experiment 2, in which the horizontal axis is elastic power and the vertical axis is the abrasion speed.

TABLE 5

| | Impact Resilience Coefficient [%] | Elastic Power [%] | The number of images produced before defective cleaning occurred in low-temperature environment | Abrasion Speed [μm/1,000 pieces] |
|---|---|---|---|---|
| Example 1 | 60 | 80 | 120000 | 0.3 |
| Example 2 | 58 | 75 | 100000 | 0.4 |
| Example 3 | 53 | 70 | 80000 | 0.5 |
| Example 4 | 50 | 66 | 70000 | 0.6 |
| Example 5 | 45 | 60 | 50000 | 0.8 |
| Example 6 | 42 | 55 | 35000 | 1.1 |
| Example 7 | 40 | 50 | 20000 | 2.0 |
| Comparative Example 1 | 35 | 45 | 6000 | 6.7 |
| Comparative Example 2 | 3 | 40 | 5000 | 8.0 |
| Comparative Example 3 | 70 | 90 | 5500 | 7.3 |

As shown in FIG. 9, when the horizontal axis is elastic power and the vertical axis is the number of images having defective cleaning, the less the elastic power, the less the defective cleaning. In addition, as shown in FIG. 10, the less the elastic power, the faster the abrasion speed. Therefore, in low-temperature environment, the less the elastic power, the faster the abrasion speed, resulting in earlier occurrence of defective cleaning.

As shown in FIG. 10, the abrasion speed quickly lowers when the elastic power is 40%. The elastic power not less than 50% noticeably prevents the blade from abrading and stably maintains cleanability in low-temperature environment.

The tip ridgeline 62*c* having an elastic power of 90% of the cleaning blade prepared in Comparative Example 3 was chipped as FIG. 6C shows after defective cleaning occurred. The tip ridgeline 62*c* having an elastic power of 90% of the cleaning blade is thought to have turned up. On the other hand, the cleaning blade the tip ridgeline of which has an elastic power of 80% had good cleanability in low-temperature environment. Therefore, the elastic power in the range of 50% to 80% decreases the abrasion of the tip ridgeline and maintains good cleanability for long periods.

Each of the cleaning blades prepared in Examples 1 to 7 and Comparative Examples 1 to 3 had good cleanability when durability test (cleanability when 10,000 images are produced) thereof was made in the same environment in Verification Experiment 1. The reason why the cleanability becomes worse in low-temperature environment than in normal temperature environment is mostly because the abrasion resistance of the blade deteriorates in low-temperature environment. The cleanability tends to be good in normal temperature environment in which the edge is difficult to wear and the abrasion speed thereof is low. Therefore, the elastic power in the range of 50% to 80% prevents the tip ridgeline of the cleaning blade from turning up and wearing in low-temperature environment.

The levelling blade 103*c* levelling a lubricant may be a blade member the tip ridgeline of which is impregnated with a cured compound comprising an acrylate or methacrylate compound having an alicyclic structure including 6 or more carbon atoms in its molecule, and has an elastic power in the range of 50% to 80%. This prevents the tip ridgeline of the levelling blade 103*c* from turning up, abnormally wearing and making noises. Further, the levelling blade improves in abrasion resistance, favorably levels a lubricant and has longer life.

Having now fully described the invention, it will be apparent to one of ordinary skill in the art that many changes and modifications can be made thereto without departing from the spirit and scope of the invention as set forth therein.

What is claimed is:

1. A blade, comprising:

an elastic member having a tip ridgeline configured to contact a surface of a member, the tip ridgeline having an impregnation layer impregnated with a cured compound, the cured compound including an acrylate or methacrylate compound having an alicyclic structure including 6 or more carbon atoms in its molecule, and the tip ridgeline having an elastic power in a range of 50% to 80%.

2. The blade of claim 1, wherein the elastic member has an impact resilience coefficient in the range of 40% to 60%.

3. The blade of claim 1, wherein the acrylate or methacrylate compound having an alicyclic structure including 6 or more carbon atoms in its molecule has 2 to 6 functional groups.

4. The blade of claim 1, wherein the acrylate or methacrylate compound having an alicyclic structure including 6 or more carbon atoms in its molecule has a molecular weight not greater than 500.

5. The blade of claim 1, wherein the acrylate or methacrylate compound having an alicyclic structure including 6 or more carbon atoms in its molecule is at least one of (i) an acrylate or methacrylate compound having a tricyclodecane structure and (ii) an acrylate or methacrylate compound having an adamantane structure.

6. The blade of claim 5, wherein the acrylate or methacrylate compound having a tricyclodecane structure is at least one of tricyclodecane dimethanol diacrylate and tricyclodecane dimethanol dimethacrylate.

7. The blade of claim 5, wherein the acrylate or methacrylate compound having an adamantane structure is at least one of 1,3-adamantane dimethanol diacrylate, 1,3-adamantane dimethanol dimethacrylate, 1,3,5-adamantane trimethanol triacrylate and 1,3,5-adamantane trimethanol trimethacrylate.

8. The blade of claim 1, wherein the cured compound further comprises:

an acrylate or methacrylate compound having a pentaerythritol triacrylate or trimethacrylate structure including 3 to 6 functional groups.

9. The blade of claim 1, wherein the elastic member is a laminated material formed of two or more rubbers having different JIS-A hardness.

10. The blade of claim 1, wherein the cured compound is an ultraviolet-cured compound.

11. The blade of claim 1, wherein the blade removes extraneous matters on the member to contact.

12. An image forming apparatus, comprising:

an image bearer configured to bear an image;

a transferer configured to transfer the image onto a recording medium; and a cleaner configured to contact a surface of the image bearer and remove extraneous matters thereon, wherein the cleaner is the blade according to claim 11.

13. A process cartridge detachable from image forming apparatus, comprising:

an image bearer configured to bear an image;

a cleaner configured to contact a surface of the image bearer and remove extraneous matters thereon; and a lubricator configured to apply a lubricant onto the surface of the image bearer, wherein the cleaner is the blade according to claim 11.

* * * * *